US012509960B2

(12) United States Patent
El Mallawany et al.

(10) Patent No.: US 12,509,960 B2
(45) **Date of Patent: *Dec. 30, 2025**

(54) FLUID TIGHT FLOAT FOR USE IN A DOWNHOLE ENVIRONMENT

(71) Applicant: Halliburton Energy Services, Inc., Houston, TX (US)

(72) Inventors: Ibrahim El Mallawany, Al-Khobar (SA); Michael Linley Fripp, Singapore (SG); Stephen Michael Greci, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/773,135

(22) Filed: Jul. 15, 2024

(65) Prior Publication Data

US 2024/0368965 A1 Nov. 7, 2024

Related U.S. Application Data

(63) Continuation of application No. 17/900,939, filed on Sep. 1, 2022, now Pat. No. 12,055,011.

(51) Int. Cl.
*E21B 34/06* (2006.01)

(52) U.S. Cl.
CPC ..... *E21B 34/06* (2013.01)

(58) Field of Classification Search
CPC ..... E21B 34/06; E21B 21/08
See application file for complete search history.

(56) References Cited

U.S. PATENT DOCUMENTS

| | | | |
|---|---|---|---|
| 10,890,067 | B2 | 1/2021 | Bukhamseen et al. |
| 11,041,361 | B2 | 6/2021 | Fripp et al. |
| 12,055,011 | B2 * | 8/2024 | El Mallawany ..... E21B 34/06 |
| 2005/0199551 | A1 | 9/2005 | Gordon |
| 2006/0177276 | A1 | 8/2006 | Stassen et al. |
| 2013/0068467 | A1 | 3/2013 | Zhou |
| 2019/0063182 | A1 | 2/2019 | Fripp et al. |
| 2020/0291745 | A1 | 9/2020 | Greci et al. |
| 2021/0324707 | A1 | 10/2021 | Aladawy et al. |
| 2022/0195837 | A1 | 6/2022 | McChesney et al. |
| 2022/0290521 | A1 | 9/2022 | Skauen et al. |
| 2022/0341290 | A1 | 10/2022 | Fripp et al. |

FOREIGN PATENT DOCUMENTS

| | | | |
|---|---|---|---|
| EP | 2383430 | A2 | 11/2011 |
| WO | 2018080313 | A1 | 5/2018 |

* cited by examiner

*Primary Examiner* — Brad Harcourt
(74) *Attorney, Agent, or Firm* — Scott Richardson; Parker Justiss, P.C.

(57) ABSTRACT

Provided is a float for use with a fluid flow control device, a fluid flow control device, a method for manufacturing a float, and a well system. The float, in one aspect, includes a fluid tight enclosure. The float, according to this aspect, further includes density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

44 Claims, 26 Drawing Sheets

FLUID TIGHT FLOAT FOR USE IN A DOWNHOLE ENVIRONMENT

CROSS-REFERENCE TO RELATED APPLICATION

This application is a continuation of U.S. patent application Ser. No. 17/900,939, entitled "FLUID TIGHT FLOAT FOR USE IN A DOWNHOLE ENVIRONMENT", filed on Sep. 1, 2022. The above-listed application is commonly assigned with the present application and is incorporated herein by reference as if reproduced herein in its entirety.

BACKGROUND

Wellbores are sometimes drilled from the surface of a wellsite several hundred to several thousand feet downhole to reach hydrocarbon resources. During certain well operations, such as production operations, certain fluids, such as fluids of hydrocarbon resources, are extracted from the formation. For example, the fluids of hydrocarbon resources may flow into one or more sections of a conveyance such as a section of a production tubing, and through the production tubing, uphole to the surface. During production operations, other types of undesirable fluids, such as water, sometimes also flow into the section of production tubing while the fluids of hydrocarbon resources are being extracted.

BRIEF DESCRIPTION

Reference is now made to the following descriptions taken in conjunction with the accompanying drawings, in which.

Figure 9A:
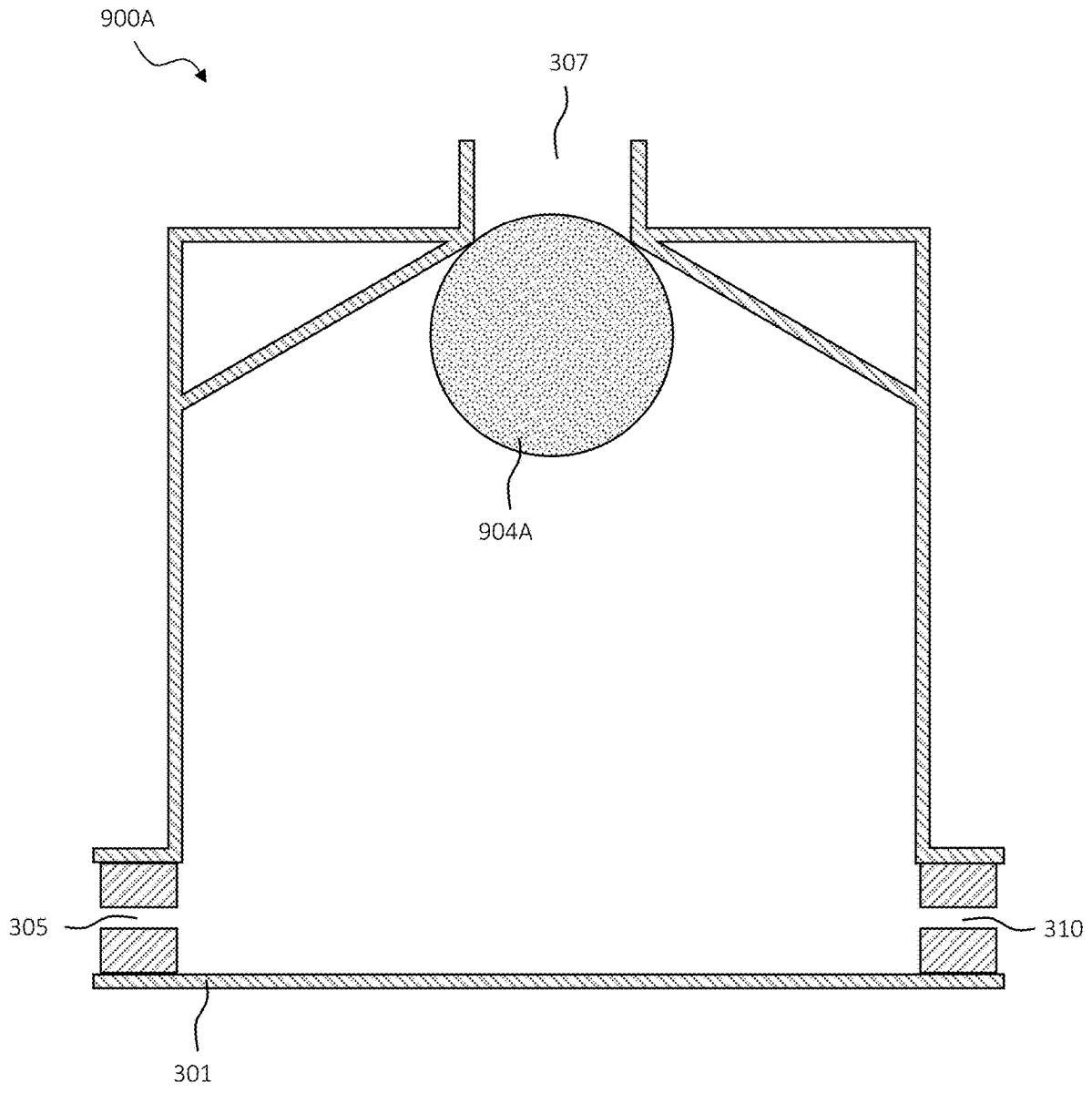
FIGS. 9A and 9B illustrate cross-sectional views of alternative embodiments of fluid flow control devices designed, manufactured, and operated according to one or more embodiments of the disclosure.
Figure 9B:
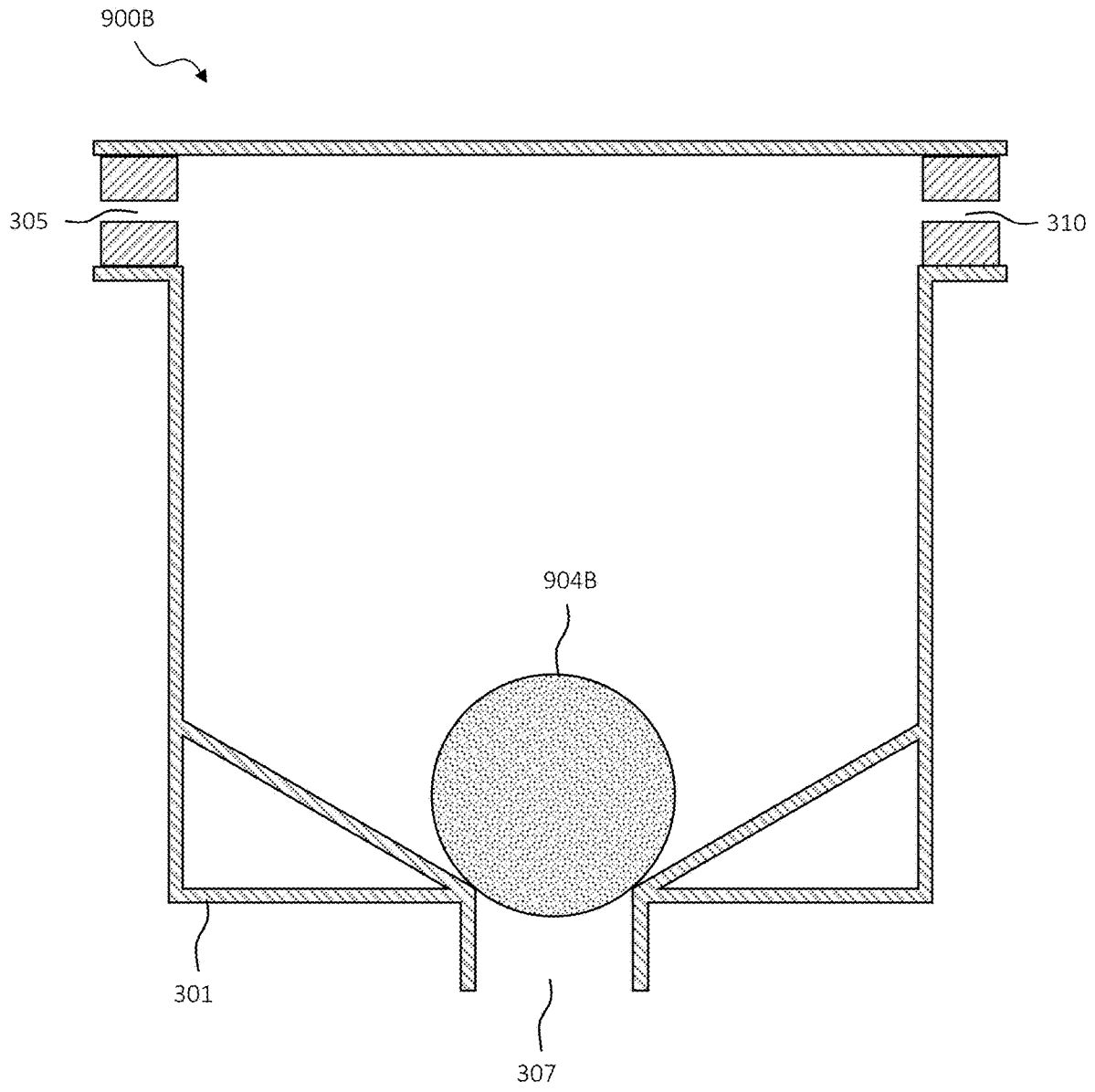
Figure 11:
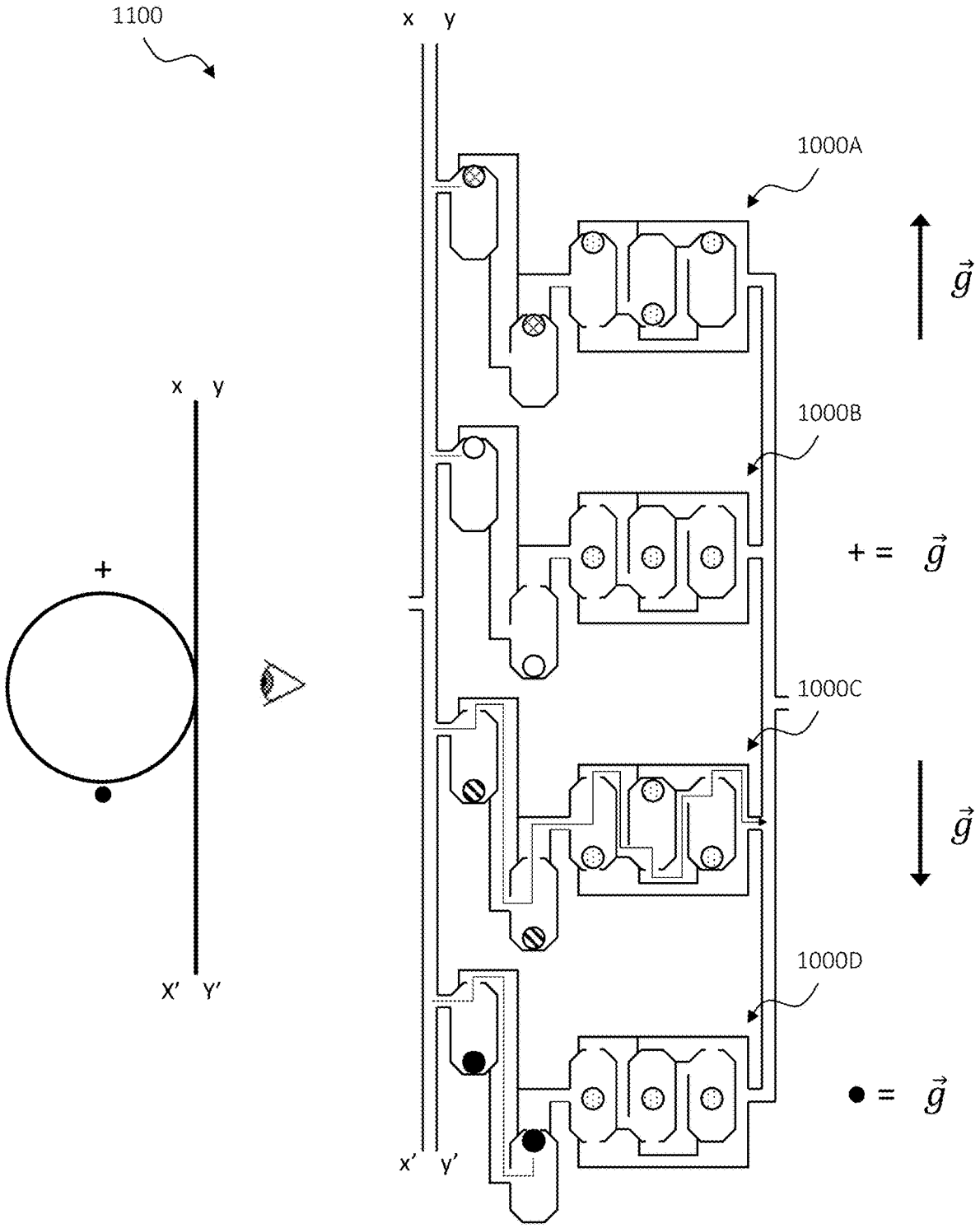

FIG. 11 illustrates a rolled-out view (360°) of a device comprising four orientation dependent inflow control apparatuses equidistantly distributed around the perimeter outside of a basepipe (not shown); and FIGS. 12A through 12G illustrate cross-sectional views of a variety of different floats (e.g., sphere shaped floats) designed, manufactured, and operated according to one or more embodiments of the disclosure, as might be used with the fluid flow control device of FIGS. 9A and 9B.

DETAILED DESCRIPTION

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well, regardless of the wellbore orientation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

The present disclosure relates, for the most part, to fluid flow control devices and downhole floats. The fluid flow control device, in at least one embodiment, includes an inlet port and an outlet port. The fluid flow control device, in at least this embodiment, also includes a float that is positioned between the inlet port and the outlet port. The float is operable to move between an open position that permits fluid flow through the outlet port and a closed position that restricts fluid flow through the outlet port. As referred to herein, an open position is a position of the float where the float does not restrict fluid flow through the outlet port, whereas a closed position is a position of the float where the float restricts fluid flow through the outlet port. In some embodiments, the float shifts radially inwards toward the outlet port to move from an open position to a closed position, and shifts radially outwards away from the outlet port to move from the closed position to the open position. In some embodiments, the float shifts radially outwards toward the outlet port to move from an open position to a closed position, and shifts radially inward away from the outlet port to move from the closed position to the open position. In some other embodiments, the float is hinged such that as the body of the float shifts radially outward while another portion of the float shifts radially inward, whether to open or close the outlet port. As referred to herein, radially inwards means shifting radially towards the center, such as the central axis, whereas radially outwards means shifting away from the center, such as away from the central axis.

In some embodiments, the float shifts circumferentially (such as circumferentially about a flow pathway of a port) from a first position to a second position to move from an open position to a closed position, and shifts from the second position to the first position to move from the closed position to the open position. In some embodiments, the float shifts linearly from a first position to a second position to move from an open position to a closed position, and shifts linearly from the second position to the first position to move from the closed position to the open position. In yet another embodiment, the float is contained within an enclosure of fluid that it is able to freely move within, the float operable to float from a first position to a second position to move from an open position to a closed position, and sink from the second position to the first position to move from the closed position to the open position. In some embodiments, the float opens to permit certain types of fluids having densities that are less than a threshold density (such as oil and other types of hydrocarbon resources) to flow through the outlet port, and restricts other types of fluids having densities greater than or equal to the threshold density (such as water and drilling fluids) from flowing through the outlet port.

The present disclosure is based, at least in part, on the acknowledgment that there is a need for low density floats for use in downhole environments. The present disclosure has further acknowledged that such downhole environments see extreme hydrostatic pressures, high temperatures, a variety of harsh chemicals, and typically require a long service life (e.g., 20 to 30 years or more), and that there is not a satisfactory solution for downhole components with a density lower than 1.3 specific gravity (sg). Based, at least in part on the foregoing acknowledgements, the present disclosure has recognized for the first time that a solution to the forgoing is manufacturing a float including a fluid tight enclosure, as well as a density specific material located within the fluid tight enclosure. In this instance, the fluid tight enclosure and the density specific material create a net density for the float that is between a first density of a desired fluid (e.g., oil) and a second density of an undesired fluid (e.g., water), such that the float may control fluid flow through a flow control device when encountering the desired fluid or the undesired fluid. The fluid tight enclosure, which may be formed of a material that does not react with the surrounding harsh environment (e.g., downhole fluids, pressures, temperatures, etc.), fully protects the density specific material located therein, thereby extending the service life of the float.

The term "fluid tight," as used herein with regard to the fluid tight enclosure, means that the enclosure having the density specific material therein (e.g., including any materials, welds, etc.) will handle at least 34.5 Bar of pressure (e.g., about 504 psi) before leaking. In at least one other embodiment, the enclosure having the density specific material therein will handle at least 68.9 Bar of pressure (e.g., about 1,000 psi) before leaking. In yet another embodiment, the enclosure having the density specific material therein will handle at least 206.8 Bar of pressure (e.g., about 3,000 psi) before leaking. In even yet another embodiment, the enclosure having the density specific material therein will handle at least 344.7 Bar of pressure (e.g., about 5,000 psi), if not 689 Bar of pressure (e.g., about 10,000 psi), before leaking. Furthermore, in at least one embodiment, the enclosure may achieve said pressures at up to a temperature of at least 100 degrees centigrade, if not at least 150 degrees centigrade.

In at least one embodiment, the floats including the fluid tight enclosure and density specific material may be used with density autonomous inflow control devices (ICDs). Often, there is a need for the float's density to be between that of oil and water (e.g., 0.75 sg and 1.0 sg, respectively) or between gas and liquids (e.g., 0.1 sg and 0.75 sg, respectively). By employing the fluid tight enclosure and density specific material, these floats can obtain a net density in this range, while handling the harsh environment that they will be deployed within.

Ultimately, the floats are designed to sink and float in a variety of downhole fluids such as: gas, oil, water/brine, and mud. The floats may be used to block or unblock flow paths in downhole flow control devices. The floats can be free floating, hinged, sliding, or any other mechanism that uses their buoyancy or a combination of buoyancy and mechanical advantage to open or close a flow path.

Figure 1:
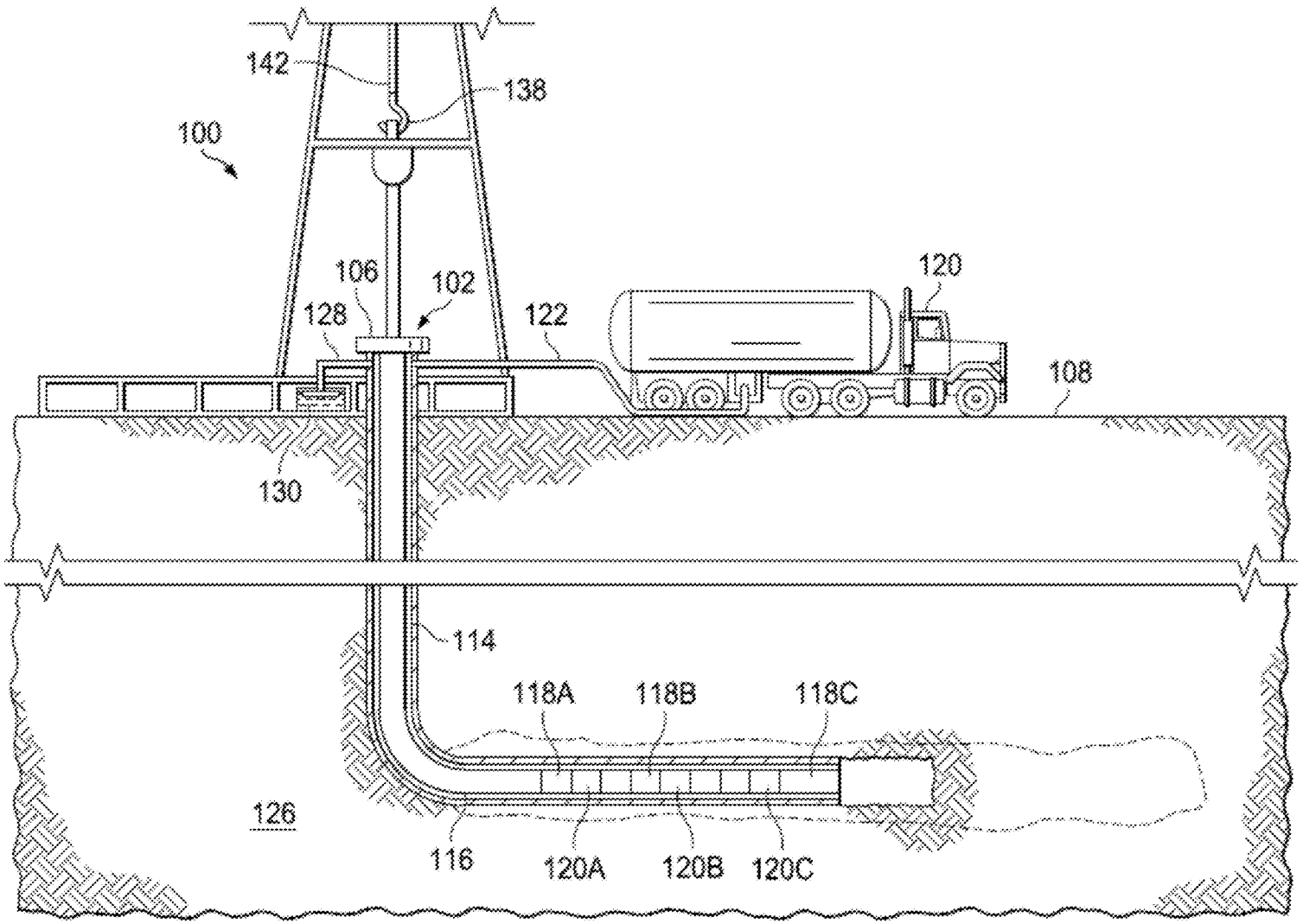
FIG. 1 illustrates a schematic, side view of a well system in which inflow control devices are deployed in a wellbore.

Turning now to the figures, FIG. 1 illustrates a schematic, side view of a well system 100 in which inflow control devices 120A-120C are deployed in a wellbore 114. As shown in FIG. 1, wellbore 114 extends from surface 108 of well 102 to or through formation 126. A hook 138, a cable 142, a traveling block (not shown), and a hoist (not shown) may be provided to lower conveyance 116 into well 102. As referred to herein, conveyance 116 is any piping, tubular, or fluid conduit including, but not limited to, drill pipe, production tubing, casing, coiled tubing, and any combination thereof. Conveyance 116 provides a conduit for fluids extracted from formation 126 to travel to surface 108. In some embodiments, conveyance 116 additionally provides a conduit for fluids to be conveyed downhole and injected into formation 126, such as in an injection operation. In some embodiments, conveyance 116 is coupled to a production tubing that is arranged within a horizontal section of well 102. In the embodiment of FIG. 1, conveyance 116 and the production tubing are represented by the same tubing.

At wellhead 106, an inlet conduit 122 is coupled to a fluid source 120 to provide fluids through conveyance 116 downhole. For example, drilling fluids, fracturing fluids, and injection fluids are pumped downhole during drilling operations, hydraulic fracturing operations, and injection operations, respectively. In the embodiment of FIG. 1, fluids are circulated into well 102 through conveyance 116 and back toward surface 108. To that end, a diverter or an outlet conduit 128 may be connected to a container 130 at the wellhead 106 to provide a fluid return flow path from wellbore 114. Conveyance 116 and outlet conduit 128 also form fluid passageways for fluids, such as hydrocarbon resources to flow uphole during production operations.

In the embodiment of FIG. 1, conveyance 116 includes production tubular sections 118A-118C at different production intervals adjacent to formation 126. In some embodiments, packers (now shown) are positioned on the left and right sides of production tubular sections 118A-118C to define production intervals and provide fluid seals between the respective production tubular section 118A, 118B, or 118C, and the wall of wellbore 114. Production tubular sections 118A-118C include inflow control devices 120A-120C (ICDs). An inflow control device controls the volume or composition of the fluid flowing from a production interval into a production tubular section, e.g., 118A. For example, a production interval defined by production tubular section 118A may produce more than one type of fluid component, such as a mixture of oil, water, steam, carbon dioxide, and natural gas. Inflow control device 120A, which is fluidly coupled to production tubular section 118A, may reduce or restrict the flow of fluid into the production tubular section 118A when the production interval is producing a higher proportion of an undesirable fluid component, such as water, which permits the other production intervals that are producing a higher proportion of a desired fluid component (e.g., oil) to contribute more to the production fluid at surface 108 of well 102, so that the production fluid has a higher proportion of the desired fluid component. In some embodiments, inflow control devices 120A-120C are autonomous inflow control devices (AICDs) that permit or restrict fluid flow into the production tubular sections 118A-118C based on fluid density, without requiring signals from the well's surface by the well operator.

Although the foregoing paragraphs describe employing inflow control devices 120A-120C during production, in some embodiments, inflow control devices 120A-120C are also employed during other types of well operations to control fluid flow through conveyance 116. Further, although FIG. 1 depicts each production tubular section 118A-118C having an inflow control device 120A-120C, in some embodiments, not every production tubular section 118A-118C has an inflow control device 120A-120C. In some embodiments, production tubular sections 118A-118C (and inflow control devices 120A-120C) are located in a substantially vertical section additionally or alternatively to the substantially horizontal section of well 102. Further, any number (e.g., one or more) of production tubular sections 118A-118C with inflow control devices 120A-120C are deployable in the well 102. In some embodiments, production tubular sections 118A-118C with inflow control devices 120A-120C are disposed in simpler wellbores, such as wellbores having only a substantially vertical section. In some embodiments, inflow control devices 120A-120C are disposed in cased wells or in open-hole environments.

In at least one embodiment, one or more of the inflow control devices 120A-120C include one or more floats designed, manufactured, and operated according to the disclosure. In accordance with at least one embodiment, the one or more floats include a fluid tight enclosure, as well as a density specific material located within the fluid tight enclosure. In accordance with this embodiment, the fluid tight enclosure and the density specific material create a net density for the float that is between a first density of a desired fluid and a second density of an undesired fluid, such that the float may control fluid flow through a flow control device when encountering the desired fluid or the undesired fluid.

Figure 2:
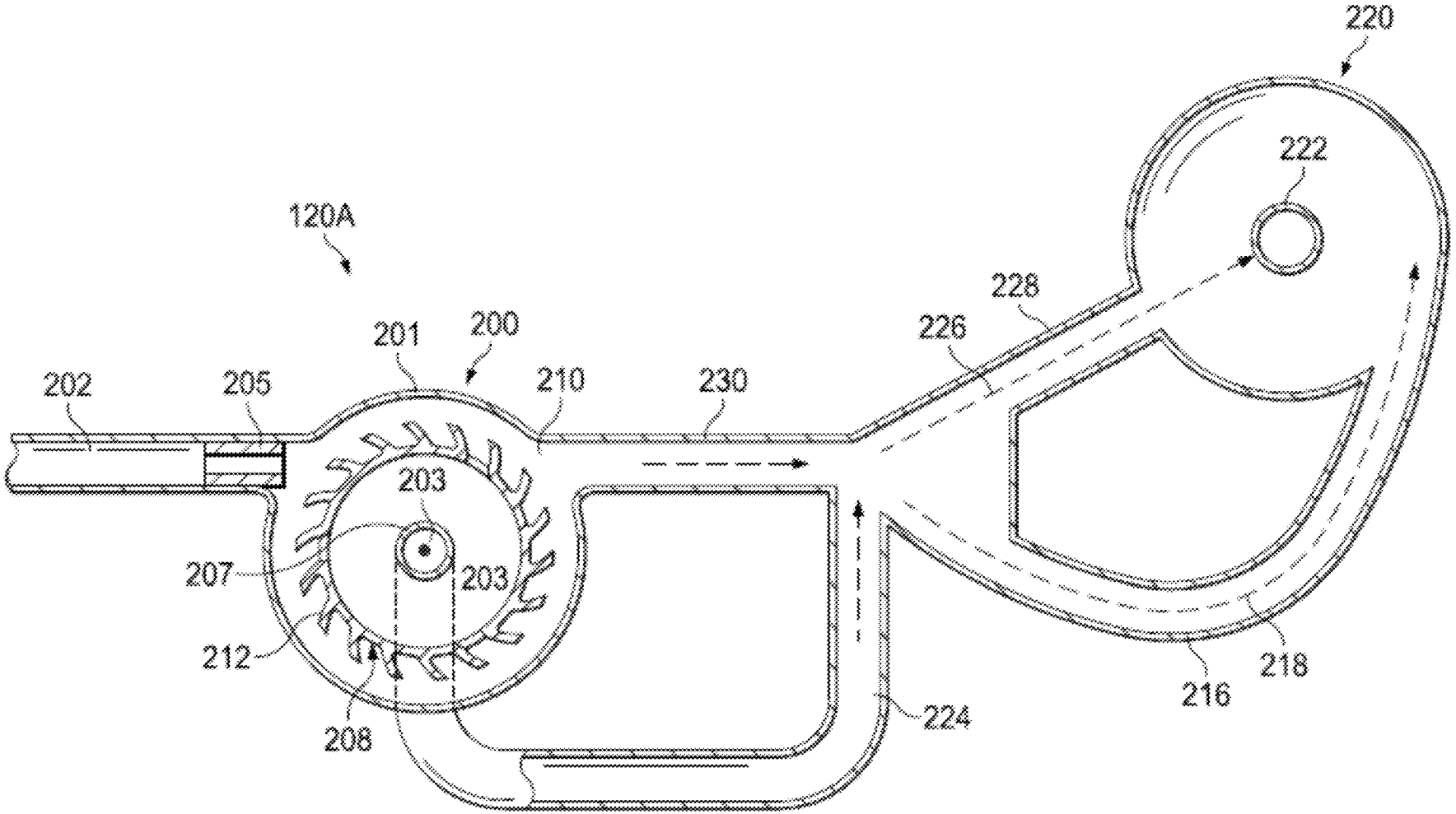
FIG. 2 illustrates a cross-sectional view of one embodiment of an inflow control device of FIG. 1.

FIG. 2 illustrates a cross-sectional view of one embodiment of an inflow control device 120A of FIG. 1. In the embodiments described in FIG. 2, inflow control device 120A includes an inflow tubular 202 of a well tool coupled to a fluid flow control device 200. Although the word "tubular" is used to refer to certain components in the present disclosure, those components have any suitable shape, including a non-circular shape. Inflow tubular 202 provides fluid to fluid flow control device 200. In some embodiments, fluid is provided from a production interval in a well system or from another location. In the embodiment of FIG. 2, inflow tubular 202 terminates at an inlet port 205 that provides a fluid communication pathway into fluid flow control device 200. In some embodiments, inlet port 205 is an opening in a housing 201 of the fluid flow control device 200.

A first fluid portion flows from inlet port 205 toward a bypass port 210. The first fluid portion pushes against fins 212 extending outwardly from a rotatable component 208 to rotate rotatable component 208 about an axis, such as a central axis 203. Rotation of rotatable component 208 about axis 203 generates a force on a float positioned within rotatable component 208. After passing by rotatable component 208, the first fluid portion exits fluid flow control device 200 via bypass port 210. From bypass port 210, the first fluid portion flows through a bypass tubular 230 to a tangential tubular 216. The first fluid portion flows through tangential tubular 216, as shown by dashed arrow 218, into a vortex valve 220. In the embodiment of FIG. 2, the first fluid portion spins around an outer perimeter of vortex valve 220 at least partially due to the angle at which the first fluid portion enters vortex valve 220. Forces act on the first fluid portion, eventually causing the first fluid portion to flow into a central port 222 of vortex valve 220. The first fluid portion then flows from central port 222 elsewhere, such as to a well surface as production fluid.

At the same time, a second fluid portion from inlet port 205 flows into rotatable component 208 via holes in rotatable component 208 (e.g., holes between fins 212 of rotatable component 208). If the density of the second fluid portion is high, the float moves to a closed position, which prevents the second fluid portion from flowing to an outlet port 207, and instead cause the second fluid portion to flow out bypass port 210. If the density of the second fluid portion is low (e.g., if the second fluid portion is mostly oil or gas), then the float moves to an open position that allows the second fluid portion to flow out the outlet port 207 and into a control tubular 224. In this manner, fluid flow control device 200 autonomously directs fluids through different pathways based on the densities of the fluids. The control tubular 224 directs the second fluid portion, along with the first fluid portion, toward central port 222 of vortex valve 220 via a more direct fluid pathway, as shown by dashed arrow 226 and defined by tubular 228. The more direct fluid pathway to central port 222 allows the second fluid portion to flow into central port 222 more directly, without first spinning around the outer perimeter of vortex valve 220. If the bulk of the fluid enters vortex valve 220 along the pathway defined by dashed arrow 218, then the fluid will tend to spin before exiting through central port 222 and will have a high fluid resistance. If the bulk of the fluid enters vortex valve 220 along the pathway defined by dashed arrow 226, then the fluid will tend to exit through central port 222 without spinning and will have minimal flow resistance.

In some embodiments, the above-mentioned concepts are enhanced by the rotation of rotatable component 208. Typically, the buoyancy force generated by the float is small because the difference in density between the lower-density fluid and the higher-density fluid is generally small, and there is only a small amount (e.g., 5 milli-Newtons) of gravitational force acting on this difference in density. This makes the fluid flow control device 200 sensitive to orientation, which causes the float to get stuck in the open position or the closed position. However, rotation of rotatable component 208 creates a force (e.g., a centripetal force or a centrifugal force) on the float. The force acts as artificial gravity that is much higher than the small gravitational force naturally acting on the difference in density. This allows fluid flow control device 200 to more reliably toggle between the open and closed positions based on the density of the fluid. This also makes fluid flow control device 200 perform in a manner that is insensitive to orientation, because the force generated by rotatable component 208 is much larger than the naturally occurring gravitational force.

In some embodiments, fluid flow control device 200 directs a fluid along the more direct pathway shown by dashed arrow 226 or along the tangential pathway shown by dashed arrow 218. In one or more of such embodiments, whether fluid flow control device 200 directs the fluid along the pathway shown by dashed arrow 226 or the dashed arrow 218 depends on the composition of the fluid. Directing the fluid in this manner causes the fluid resistance in vortex valve 220 to change based on the composition of the fluid.

In some embodiments, fluid flow control device 200 is compatible with any type of valve. For example, although FIG. 2 includes a vortex valve 220, in other embodiments, vortex valve 220 is replaced with other types of fluidic valves, including valves that have a moveable valve-element, such as a rate-controlled production valve. Further, in some embodiments, fluid control device 202 operates as a pressure sensing module in a valve.

Figure 3:
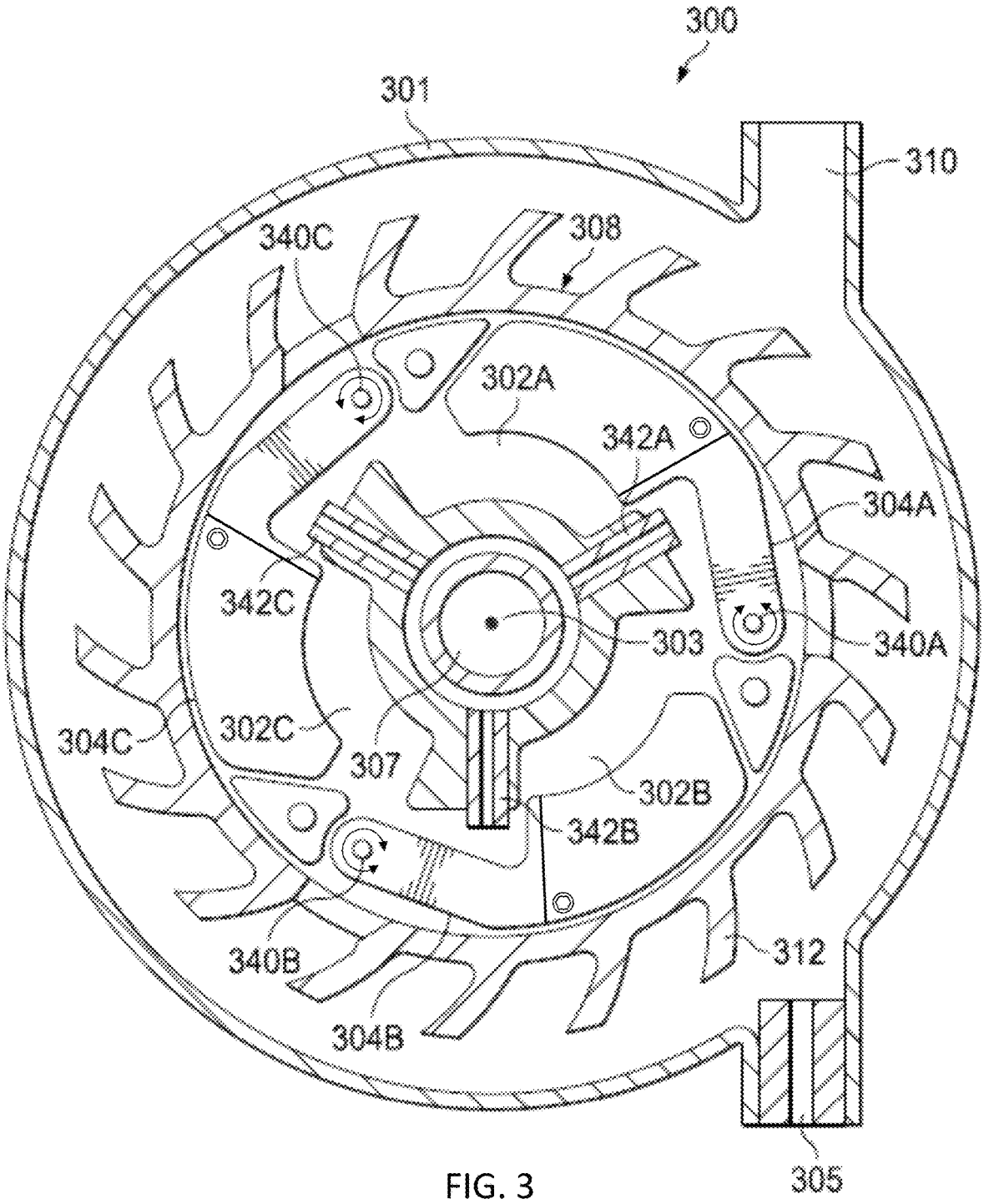
FIG. 3 illustrates a cross-sectional view of a fluid flow control device similar in certain embodiments to fluid flow control device of FIG. 2.

FIG. 3 is a cross-sectional view of a fluid flow control device 300 similar in certain embodiments to fluid flow control device 200 of FIG. 2. With reference now to FIG. 3, fluid flow control device 300 includes a rotatable component 308 positioned within a housing 301 of fluid flow control device 300. Fluid flow control device 300 also includes an inlet port 305 that provides a fluid passage for fluids such as, but not limited to, hydrocarbon resources, wellbore fluids, water, and other types of fluids to flow into housing 301. Fluid control device 300 also includes an outlet port 310 that provides a fluid flow path for fluids to flow out of fluid flow control device 300, such as to vortex valve 220 of FIG. 2. Some of the fluids that flow into housing 301 also come into contact with rotatable component 308, where force generated by fluids flowing onto rotatable component 308 rotates rotatable component 308 about axis 303. In some embodiments, fluids flowing through inlet port 305 push against fins, including fin 312, which are coupled to rotatable component 308, where the force of the fluids against the fins rotates rotatable component 308 about axis 303. Three floats 304A-304C are positioned within the rotatable component 308 and are connected to the rotatable component 308 by hinges 340A-340C, respectively, where each hinge 340A, 340B, and 340C provides for movement of a respective float 304A, 304B, and 304C relative to rotatable component 308 between the open and closed positions. In some embodiments, movements of each float 304A, 304B, and 304C between the open and the closed positions are based on fluid densities of the fluids in the rotatable component 308.

In some embodiments, movement of floats 304A-304C back and forth between the open and closed positions is accomplished by hinging each respective float 304A, 304B, or 304C on its hinge 340A, 340B, or 340C. In some embodiments, each hinge 340A, 340B, and 340C includes a pivot rod (not shown) mounted to rotatable component 308 and passing at least partially through float 304A, 304B, and 304C, respectively. In some embodiments, in lieu of the pivot rod mounted to rotatable component 308, each float 304A, 304B, and 304C has bump extensions that fit into recesses of rotatable component 308 for use as a hinge. In some embodiments, floats 304A-304C are configured to move back and forth from the open and closed positions in response to changes in the average density of fluids, including mixtures of water, hydrocarbon gas, and/or hydrocarbon liquids, introduced at inlet port 305. For example, floats 304A-304C are movable from the open position to the closed position in response to the fluid from inlet port 305 being predominantly water or mud, wherein the float component is movable from the closed position to the open position in response to the fluid from the inlet port 305 being predominantly a hydrocarbon, such as oil or gas.

In the embodiment of FIG. 3, rotatable component 308 includes three fluid pathways 342A-342C that provide fluid communication between inlet port 305 and an outlet port 307. Further, each fluid pathway 342A, 342B, and 342C is fluidly connected to a chamber 302A, 302B, and 302C, respectively. Moreover, each float 304A, 304B, and 304C is disposed in a chamber 302A, 302B, and 302C, respectively, such that shifting a float 304A, 304B, or 304C from an open position to a closed position restricts fluid flow through a corresponding fluid pathway 342A, 342B, or 342C, respectively, whereas shifting float 304A, 304B, or 304C from the closed position to the open position permits fluid flow through corresponding fluid pathway 342A, 342B, or 342C. In some embodiments, float 304A, 304B, or 304C permits or restricts fluid flow through fluid pathway 342A, 342B, or 342C, respectively, based on the density of the fluid in chamber 302A, 302B, or 302C, respectively. Although FIG. 3 illustrates three floats 304A-304C positioned in three chambers 302A-202C, respectively, in some embodiments, a different number of floats positioned in a different number of chambers are placed in rotatable component 308. Further, although FIG. 3 illustrates three fluid pathways 342A-342C, in some embodiments, rotatable component 308 includes a different number of fluid pathways that fluidly connect inlet port 305 to outlet port 307.

In the illustrated embodiment, the one or more of the floats 304A-304C each comprise a fluid tight enclosure, as well as a density specific material located within the fluid tight enclosure. In the illustrated embodiment, the fluid tight enclosure includes an enclosed space formed of one or more sheets of material physically attached together, as well as a support structure coupled to an exposed end of the enclosed space. In the illustrated embodiment, each of the one or more of the floats 304A-304C additionally includes a one or more fill ports and one or more associated fill plugs in the support structure or the enclosed space to place the density specific material within the fluid tight enclosure.

FIGS. 4A through 4D illustrate cross-sectional views of a variety of different steps for manufacturing a float 404 designed, manufactured, and operated according to one or more embodiments of the disclosure, as might be used with the fluid flow control device 300 of FIG. 3. For example, the float 404 could be configured to move back and forth between the open and closed positions by rotating about a hinge point.

Figure 4A:
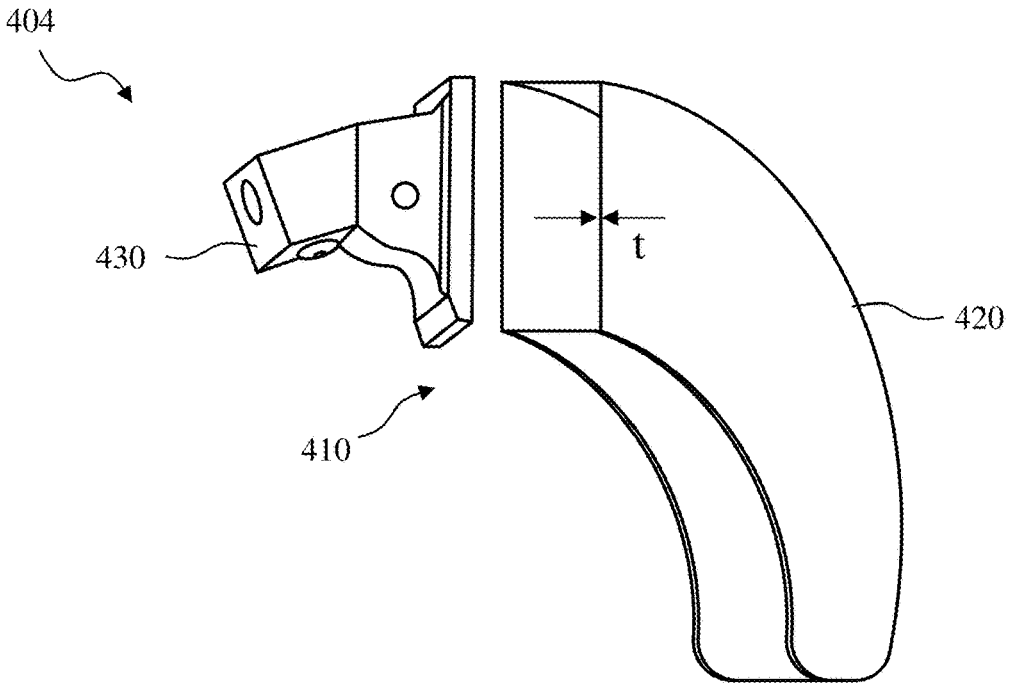
FIGS. 4A through 4D illustrate cross-sectional views of a variety of different steps for manufacturing a float designed, manufactured, and operated according to one or more embodiments of the disclosure, as might be used with the fluid flow control device 300 of FIG. 3.

With initial reference to FIG. 4A, the float 404 begins with an enclosed space 420 and a support structure 430, which when combined will ultimately form a fluid tight enclosure 410. The enclosed space 420, in at least one embodiment, is shaped into a desired form (e.g., in this embodiment a kidney shaped paddle). For example, the enclosed space 420 could include one or more sheets of material cut to a desired shape and then physically attached together into the desired form. In at least one embodiment, the enclosed space 420 includes two or more sheets of material physically attached together into the desired form. In at least one embodiment, the sheets of material comprise a substance that easily handles the downhole environment that the float 404 will be located. For example, in at least one embodiment the sheets of material comprise metal or a metal alloy. For example, in at least one embodiment, the sheets of material may comprise titanium or Inconel®, among other metals and/or alloys. In those embodiments wherein the sheets of material comprise metal, the two or more sheets of metal may be physically welded (e.g., laser, tig, mig, etc.) together into the desired form. Nevertheless, other materials different from metals and metal alloys may be used for the sheet material and remain within the scope of the disclosure. Furthermore, the enclosed space 420 may be manufacturing using one or more different types of additive manufacturing processes.

In at least one embodiment, the enclosed space 420 has a wall thickness (t) of less than 2.54 mm. In yet another embodiment, the enclosed space 420 has a wall thickness (t) of less than 1.27 mm. In even yet another embodiment, the enclosed space 420 has a wall thickness (t) of less than 0.254 mm. Ultimately, the material, wall thickness (t) and mechanism for physically attaching the features (e.g., along with the density specific material therein) should be able to withstand the downhole conditions to remain fluid tight.

The support structure 430, in the embodiment of FIG. 4A, is not yet connected to the enclosed space 420, and thus the fluid tight enclosure 410 is not yet fluid tight. The support structure 430, in at least one embodiment, is a hinge structure, as might be used with the fluid flow control device 300 of FIG. 3. The support structure 430, in at least one other embodiment (e.g., such as shown) is a counterweight hinge structure. The support structure 430, in one or more embodiments, may comprise a material that is compatible with the material of the one or more sheets of material. Thus, in the illustrated embodiment, the support structure 430 comprises a metal or metal alloy.

Figure 4B:
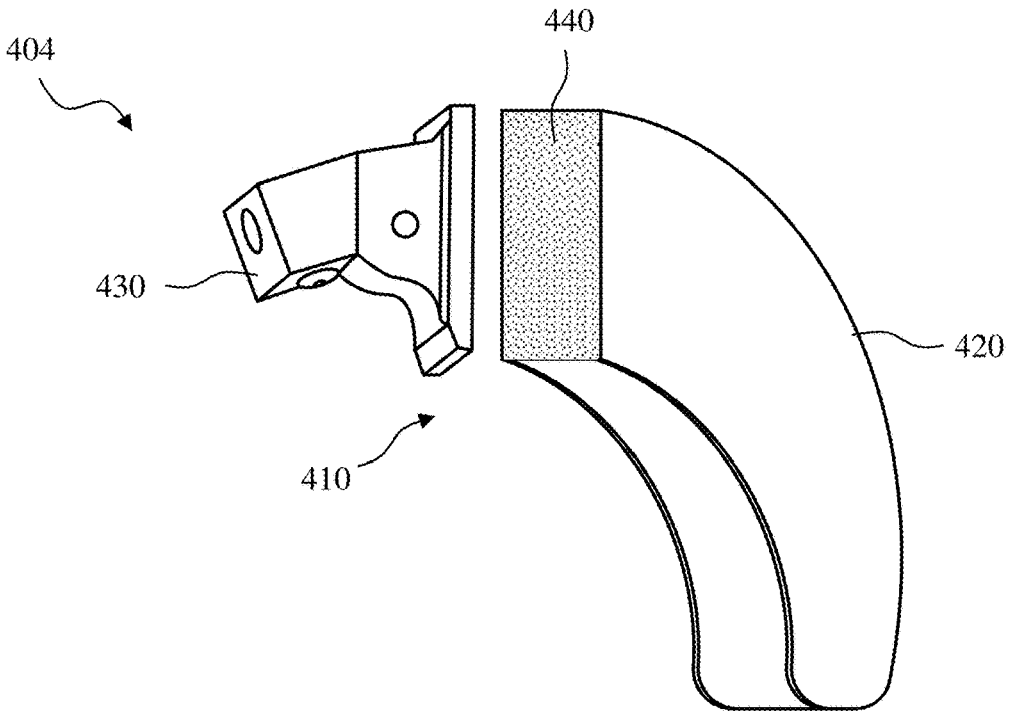

Turing to FIG. 4B, a density specific material 440 has been positioned within the enclosed space 420. As the enclosed space 420 has an exposed end at this point in the manufacturing process, it is easy to position the density specific material 440 therein. The density specific material 440 may comprise a variety of different substances and remain within the purview of the disclosure. In the illustrated embodiment, the density specific material 440 is a light-weight solid such that the net density for the float 404 is between a first density of a desired fluid and a second density of an undesired fluid. In at least one embodiment, light-weight solid is foam. In yet another embodiment, the light-weight solid is syntactic foam, or alternatively closed cell foam or open cell foam. As the density specific material 440 is a solid, it may be placed within the enclosed space 420 without worry that it might easily escape.

In yet other embodiments, however, the density specific material 440 is a light-weight fluid such that the net density for the float is between the first density of the desired fluid and the second density of the undesired fluid. For example, in at least one embodiment the light-weight fluid includes oil, or alternatively a combination of oil and another fluid. In yet another embodiment, the light-weight fluid is water, the water further including microglass spheres suspended therein such that the net density for the float is between the first density of the desired fluid and the second density of the undesired fluid. In yet even another embodiment, the density specific material is pressurized gas. For example, the pressure could build after the fluid tight enclosure 410 has been sealed, such as with a solid carbon dioxide (e.g., dry ice) sublimating into a pressurized gaseous carbon dioxide.

Figure 4C:
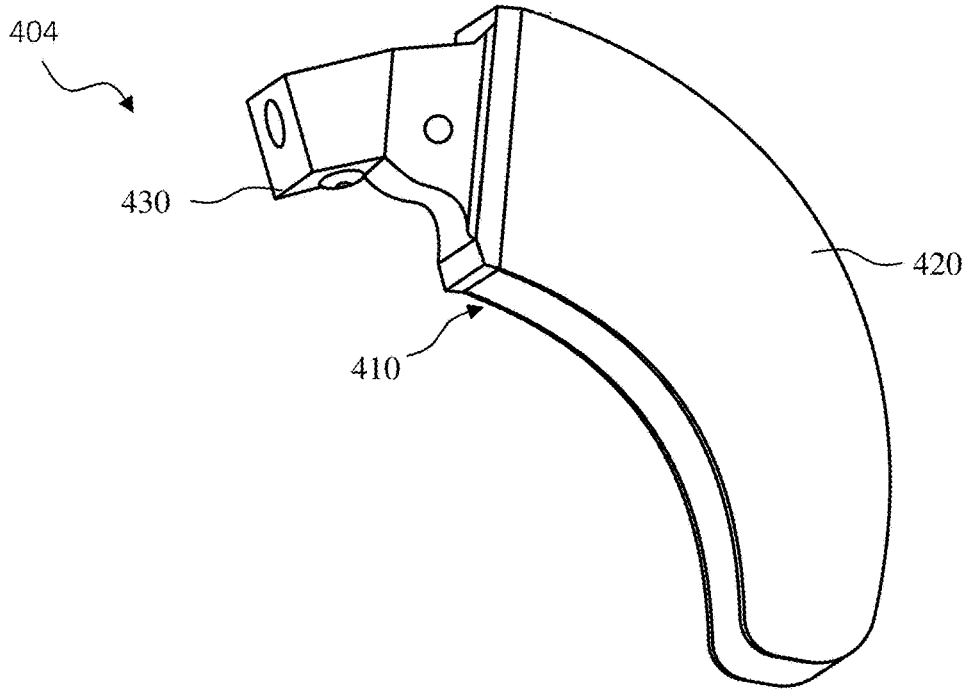

Turning to FIG. 4C, the support structure 430 has been physically attached to the enclosed space 420, ultimately forming the fluid tight enclosure 410 having the density specific material 440 located therein. In at least one embodiment, the support structure 430 is welded to the enclosed space 420 to form the fluid tight enclosure 410.

Figure 4D:
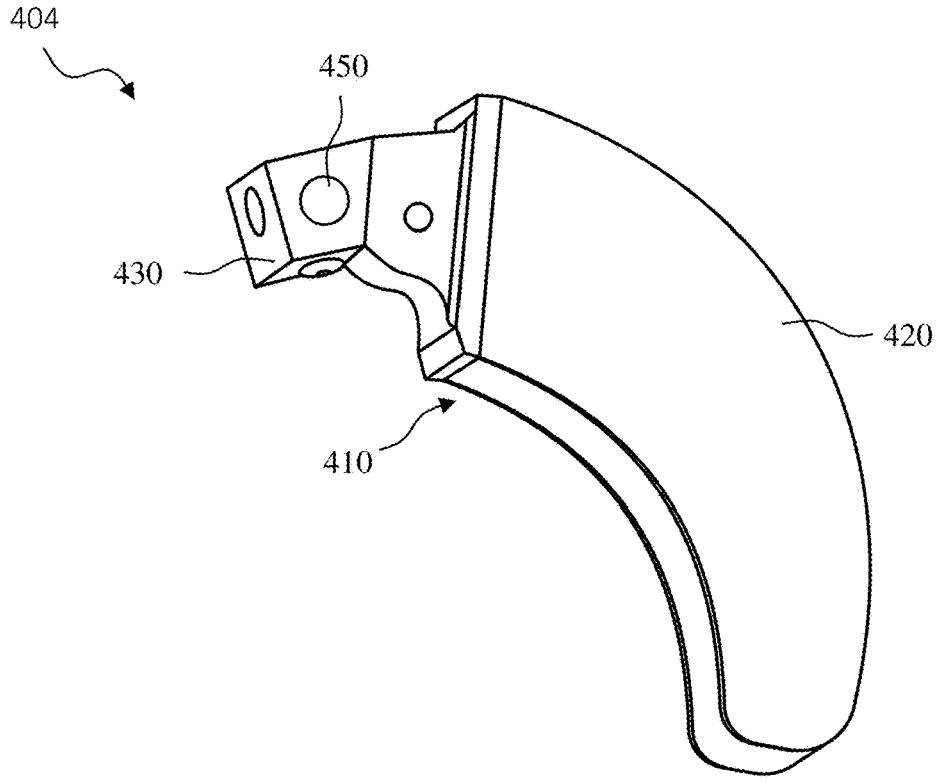

Turning to FIG. 4D, an overall density of the float 404 has been fine-tuned to a specific value, such that its net density is between a first density of a desired fluid and a second density of an undesired fluid. In the embodiment of FIG. 4D, this net density may be fine-tuned by adding or removing weight from the fluid tight enclosure 410 or the support structure 430. In the illustrated embodiment of FIG. 4D, the net density is fine-tuned by adding or removing weight from the counterweight portion of the support structure 430. Specific to the embodiment of FIG. 4D, one or more holes/pockets 450 have been formed in the support structure 430 to decrease/increase the net density of the float 404. The holes/pockets 450 may remain empty in those embodiments wherein it is necessary to decrease the net density, and may be filled with a very dense material when it is necessary to increase the net density. What results, in a least one embodiment, is a float 404 having a net density between that of oil and water (e.g., 0.75 sg and 1.0 sg, respectively). In yet another embodiment, what results is a float 404 having a net density between gas and liquids (e.g., 0.1 sg and 0.75 sg, respectively).

Turning to FIGS. 5A through 5E, illustrated is an alternative embodiment for forming a float 504. The float 504 is similar in many respects to the float 404. Accordingly, like reference numbers have been used to indicate similar, if not identical, features. The float 504 differs, for the most part, from the float 404 in that the float 504 includes one or more fill ports 535*a* and one or more fill plugs 535*b*. For example, in the embodiment of FIGS. 5A through 5E, a single fill port 535*a* and a single fill plug 535*b* are located in the support structure 530. Nevertheless, other embodiments may exist wherein the two or more fill ports 535*a* and two or more fill plugs 535*b* are located in the enclosed space 420, for example to circulate the density specific material therethrough to make sure air is purged from the enclosed space 420. The embodiment employing one or more fill ports 535*a* and one or more fill plugs 535*b* is particularly useful when the density specific material is not a solid (e.g., is a liquid, gas, etc.), for apparent reasons. The embodiment employing the one or more fill ports 535*a* and the one or more fill plugs 535*b* is also useful when the density specific material does not start out as a solid, but transitions to a solid over time (e.g., an epoxy, a melted syntactic foam, other melted material, etc.).

Figure 5A:
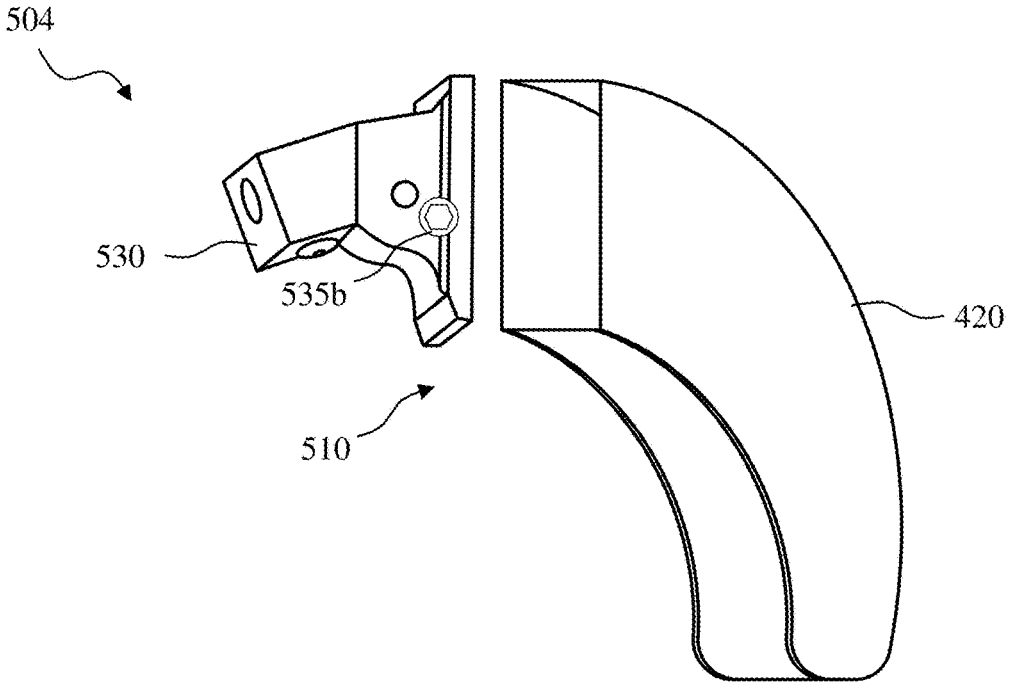
FIGS. 5A through 5E illustrate cross-sectional views of a variety of different steps for manufacturing a float designed, manufactured, and operated according to one or more alternative embodiments of the disclosure, as might be used with the fluid flow control device 300 of FIG. 3.

With reference to FIG. 5A, the enclosed space 420 and the support structure are separate from one another. In this embodiment, the fill plug 535*b* remains within the fill port 535*a* in the support structure 530. In other embodiments, the fill plug 535*b* could be removed from the fill port 535*a* at this stage of manufacture. Further to this embodiment, the density specific material has not been located within the enclosed space 420.

Figure 5B:
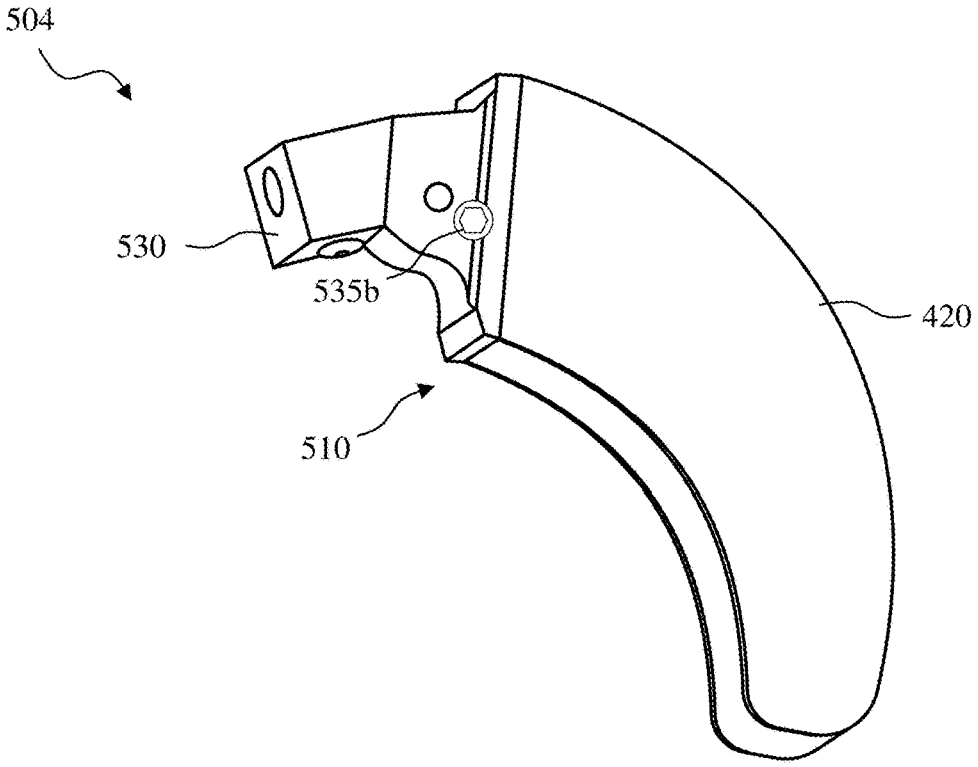

With reference to FIG. 5B, the support structure 530 has been attached to the enclosed space 420. Again, in at least one embodiment, the density specific material has yet to be located within the enclosed space 420.

Figure 5C:
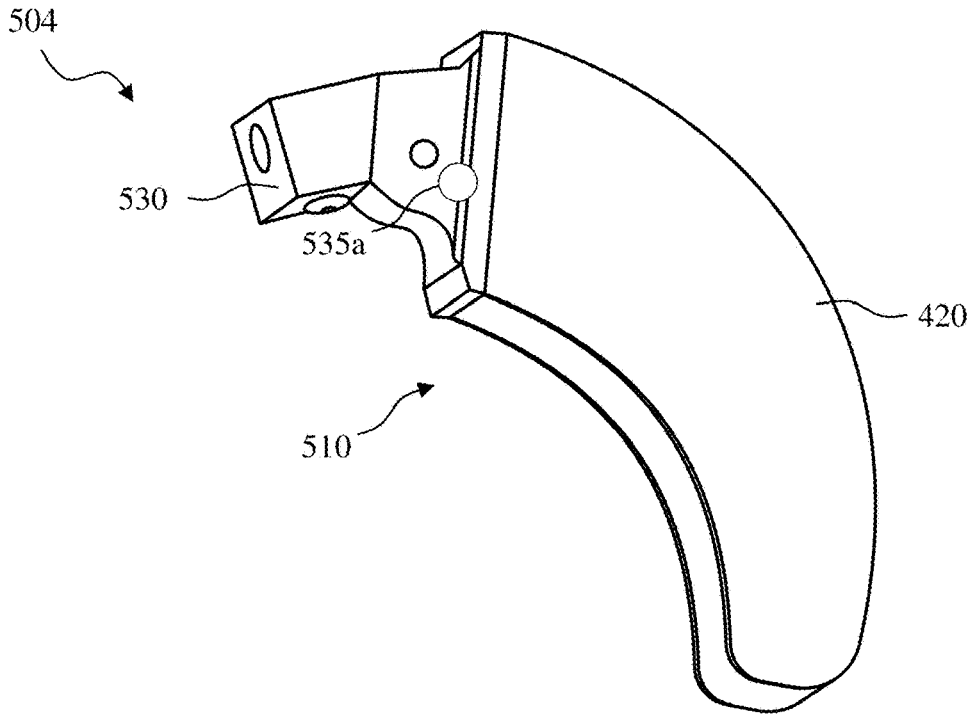

With reference to FIG. 5C, the fill plug 535*b* has been removed, exposing the fill port 535*a*. Additionally, the density specific material (not shown) has been located within the enclosed space 420. The density specific material may comprise any of the materials disclosed above, so long as it may be injected into the enclosed space 420 via the fill port 535*a*. Particularly useful are liquids, gases, foams, etc.

Figure 5D:
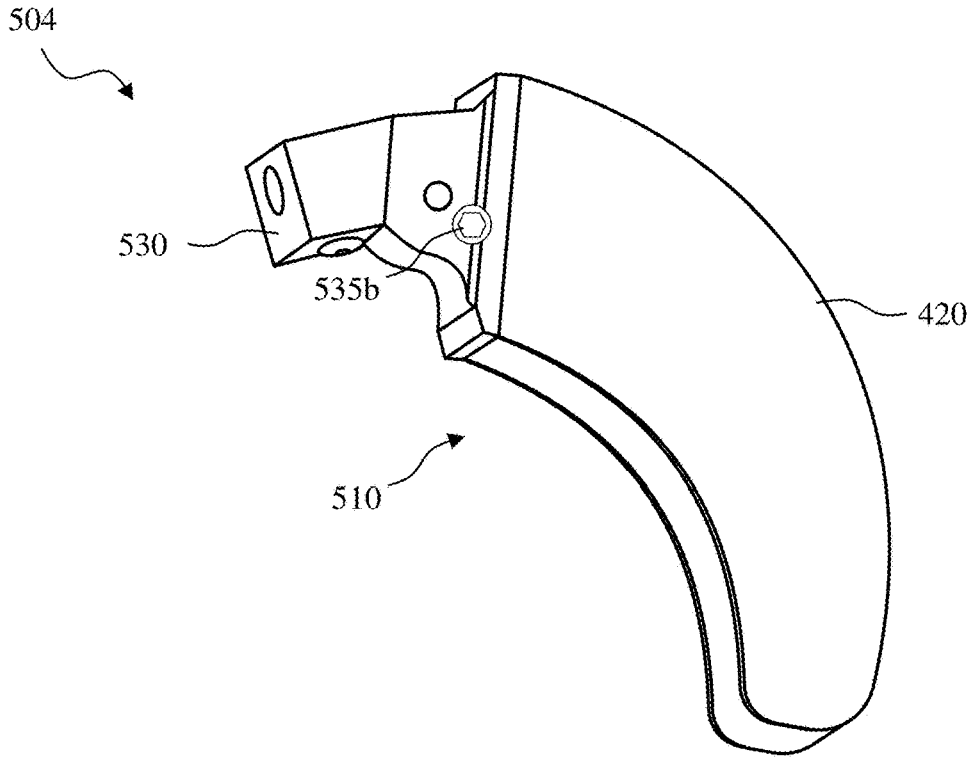

With reference to FIG. 5D, the fill plug 535*b* has been replaced within the fill port 535*a*. Accordingly, at this stage the float 504 includes a fluid tight enclosure 510.

Figure 5E:
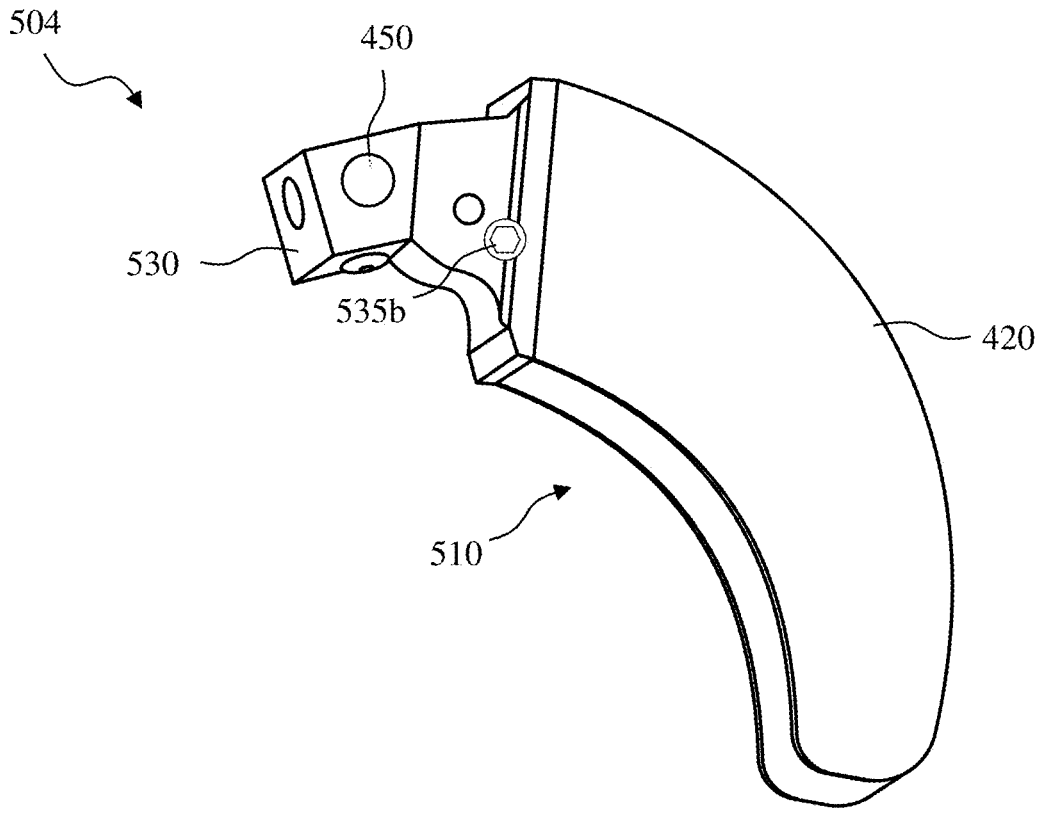

With reference to FIG. 5E, an overall density of the float 504 has been fine-tuned to a specific value, such that its net density is between a first density of a desired fluid and a second density of an undesired fluid. In the embodiment of FIG. 5E, this net density may be fine-tuned by adding or removing weight from the fluid tight enclosure 510 or the support structure 530. In the illustrated embodiment of FIG. 5E, the net density is fine-tuned by adding or removing weight from the counterweight portion of the support structure 530. Specific to the embodiment of FIG. 5E, one or more holes/pockets 450 have been formed in the support structure 530 to decrease/increase the net density of the float 504. The holes/pockets 450 may remain empty in those embodiments wherein it is necessary to decrease the net density, and may be filled with a very dense material when it is necessary to increase the net density.

FIGS. 6A through 6G illustrate cross-sectional views of a variety of different floats (e.g., paddled shaped floats) 604A-604G designed, manufactured, and operated according to one or more embodiments of the disclosure, as might be used with the fluid flow control device 300 of FIG. 3. For example, each of the floats 604A-604G could be configured to move back and forth between the open and closed positions by rotating about a hinge point.

Each of the different floats 604A-604G illustrated in the embodiments of FIGS. 6A through 6G, in one form or another, includes a fluid tight enclosure (e.g., including an enclosed space, with or without a support structure) and density specific material located within the fluid tight enclosure. Accordingly, the fluid tight enclosure and the density specific material create a net density for the floats 604A-604G that is between a first density of a desired fluid and a second density of an undesired fluid, such that the floats 604A-604G may control fluid flow through a flow control device when encountering the desired fluid or the undesired fluid. In at least one embodiment, the floats 604A-604G have a net density that is above a first density of a desired fluid and below a second density of an undesired fluid. In another embodiment, the floats 604A-604G have a net density that is above a first density of an undesired fluid and below a second density of a desired fluid.

Figure 6A:
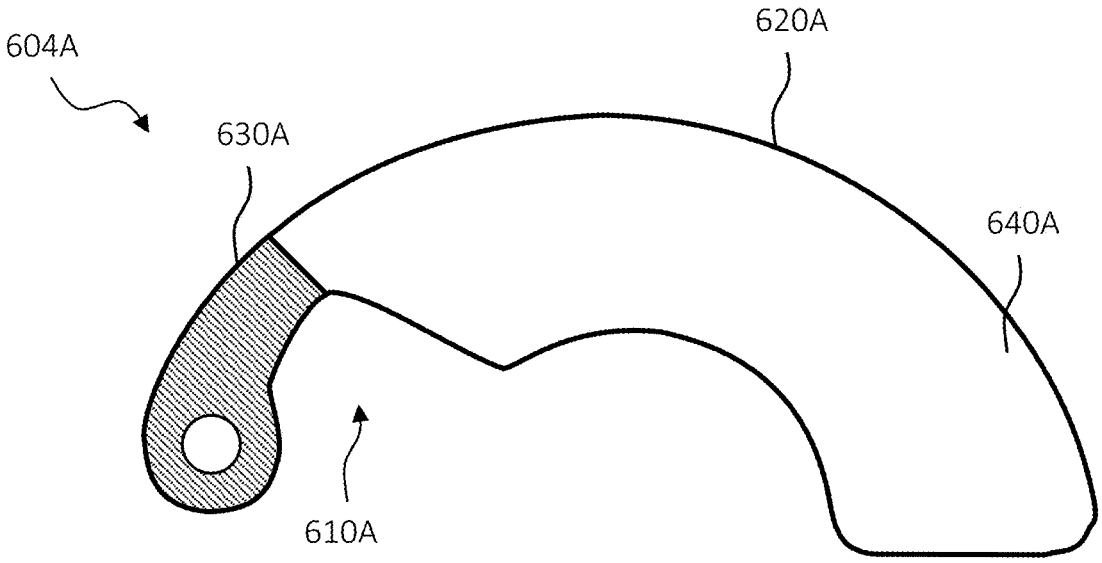
FIGS. 6A through 6G illustrate cross-sectional views of a variety of different floats (e.g., paddled shaped floats) designed, manufactured, and operated according to one or more embodiments of the disclosure, as might be used with the fluid flow control device of FIG. 3.

With initial reference to FIG. 6A, illustrated is one embodiment of a float 604A designed, manufactured, and operated according to one or more embodiments of the disclosure. The float 604A includes a fluid tight enclosure 610A. The fluid tight enclosure 610A in the embodiment of FIG. 6A includes an enclosed space 620A and a support structure 630A. The float 604A of FIG. 6A additionally includes a density specific material 640A located within the fluid tight enclosure 610A. In this embodiment, the fluid tight enclosure 610A and the density specific material 640A create a net density for the float 604A that is between a first density of a desired fluid and a second density of an undesired fluid. In the illustrated embodiment, the density specific material 640A is a light-weight solid, such that the net density for the float 604A is between the first density of the desired fluid and the second density of the undesired fluid. Those skilled in the art, particularly given that it is protected by the fluid tight enclosure 610A, understand the various different light-weight solids that may be used and remain within the scope of the disclosure.

Figure 6B:
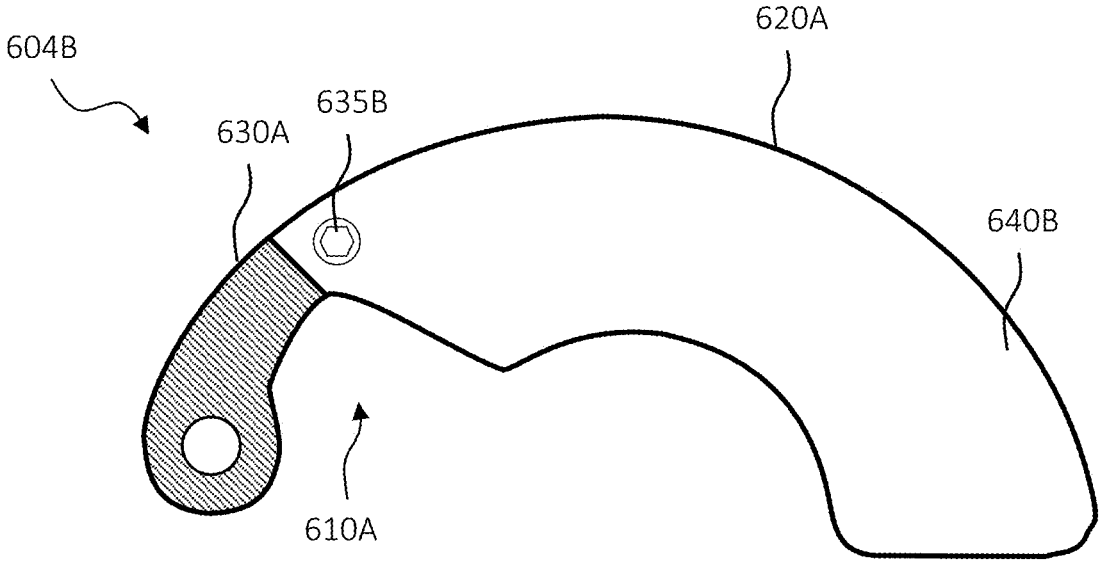

Turning now to FIG. 6B, illustrated is an alternative embodiment of a float 604B designed, manufactured, and operated according to another embodiment of the disclosure. The float 604B is similar in many respects to the float 604A of FIG. 6A. Accordingly, like reference numbers have been used to indicate similar, if not identical, features. The float 604B differs, for the most part, from the float 604A in that the float 604B employs a light-weight fluid as its density specific material 640B, such that the net density for the float 604B is between the first density of the desired fluid and the second density of the undesired fluid. In at least one embodiment, the light-weight fluid contains oil, for example among other fluids. In at least one other embodiment, the light-weight fluid is oil. In at least one other embodiment, the light-weight fluid includes gasses, for example among other fluids. Further to the embodiment of FIG. 6B, the float 604B may additionally include one or more fill ports (e.g., covered in the illustrated embodiment) and one or more fill plugs 635B. Given the fluid nature of the density specific material 640B, the one or more fill ports and one or more fill plugs 635B may be used to locate the density specific material 640B within the fluid tight enclosure 610A.

Figure 6C:
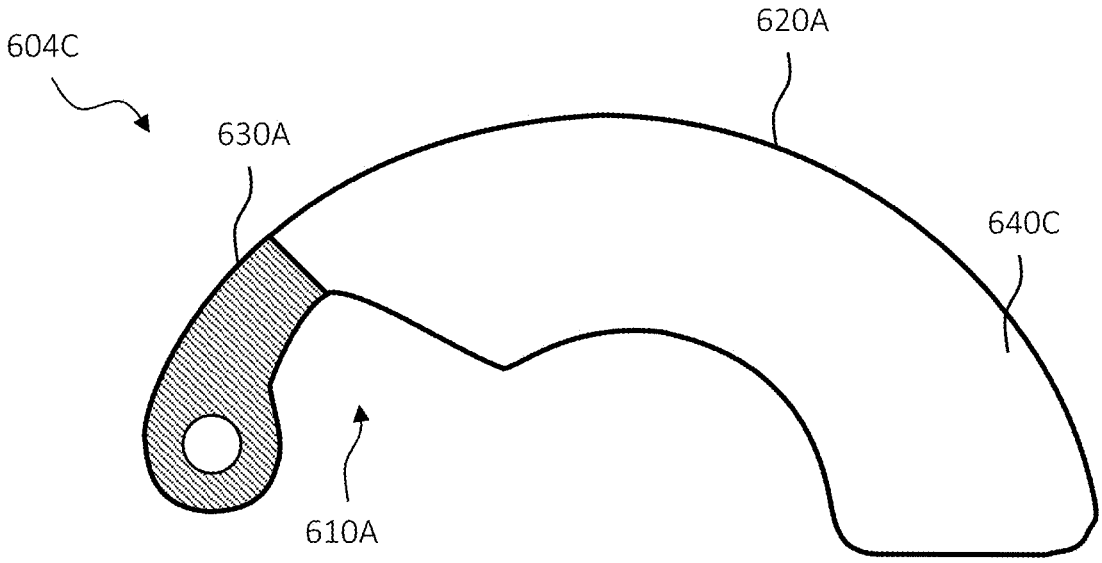

Turning now to FIG. 6C, illustrated is an alternative embodiment of a float 604C designed, manufactured, and operated according to another embodiment of the disclosure. The float 604C is similar in many respects to the float 604A of FIG. 6A. Accordingly, like reference numbers have been used to indicate similar, if not identical, features. The float 604C differs, for the most part, from the float 604A in that the float 604C employs a light-weight foam as its density specific material 640C. In the illustrated embodiment, the density specific material 640C is syntactic foam, for example including light weight material that is created by using hollow spheres, often made of glass, which are bound together with a base material (e.g., a thermoset polymer). Those skilled in the art understand that the syntactic foam, and the sizing of the hollow spheres, may be used to adjust the net density of the float 604C.

Figure 6D:
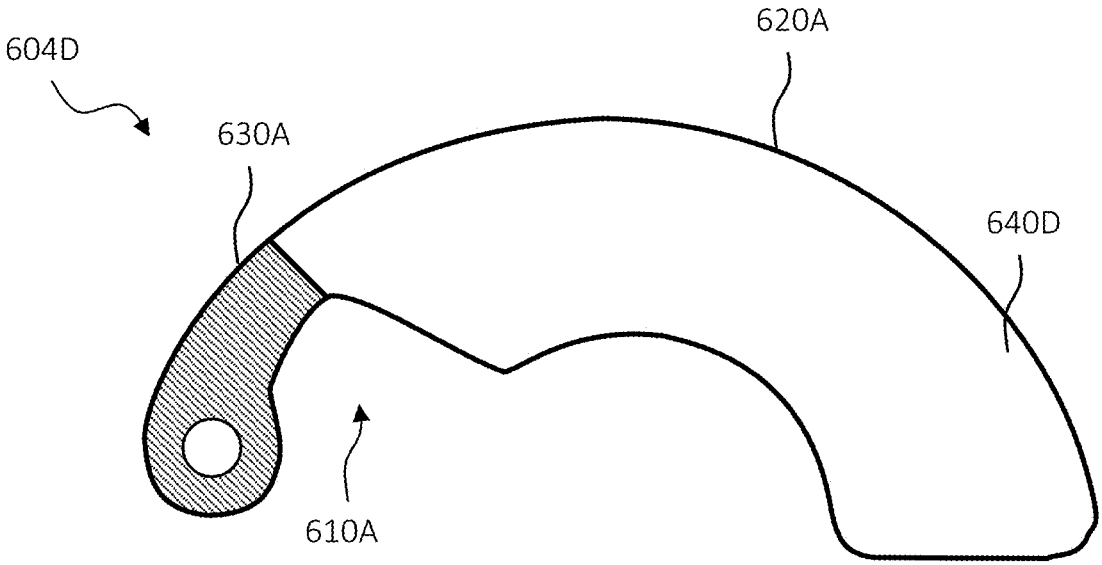

Turning now to FIG. 6D, illustrated is an alternative embodiment of a float 604D designed, manufactured, and operated according to another embodiment of the disclosure. The float 604D is similar in many respects to the float 604C of FIG. 6C. Accordingly, like reference numbers have been used to indicate similar, if not identical, features. The float 604D differs, for the most part, from the float 604C in that the float 604D employs an open cell foam as its density specific material 640D. Those skilled in the art understand that the open cell foam, and the sizing of the cells, may be used to adjust the net density of the float 604D.

Figure 6E:
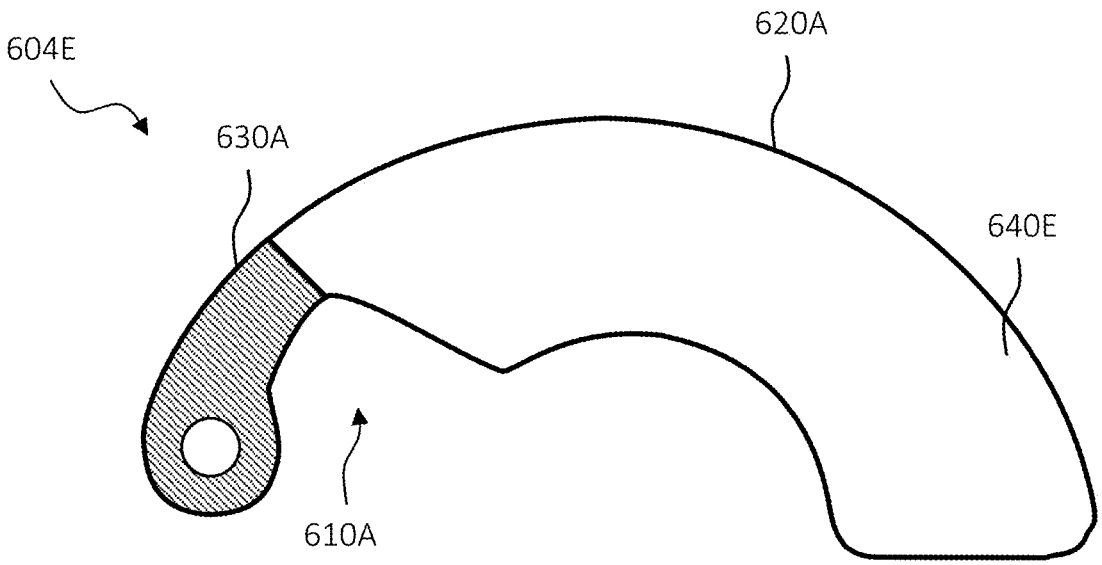

Turning now to FIG. 6E, illustrated is an alternative embodiment of a float 604E designed, manufactured, and operated according to another embodiment of the disclosure. The float 604E is similar in many respects to the float 604C of FIG. 6C. Accordingly, like reference numbers have been used to indicate similar, if not identical, features. The float 604E differs, for the most part, from the float 604C in that the float 604E employs closed cell foam as its density specific material 640E. Those skilled in the art understand that the closed cell foam, and the sizing of the cells, may be used to adjust the net density of the float 604E.

Figure 6F:
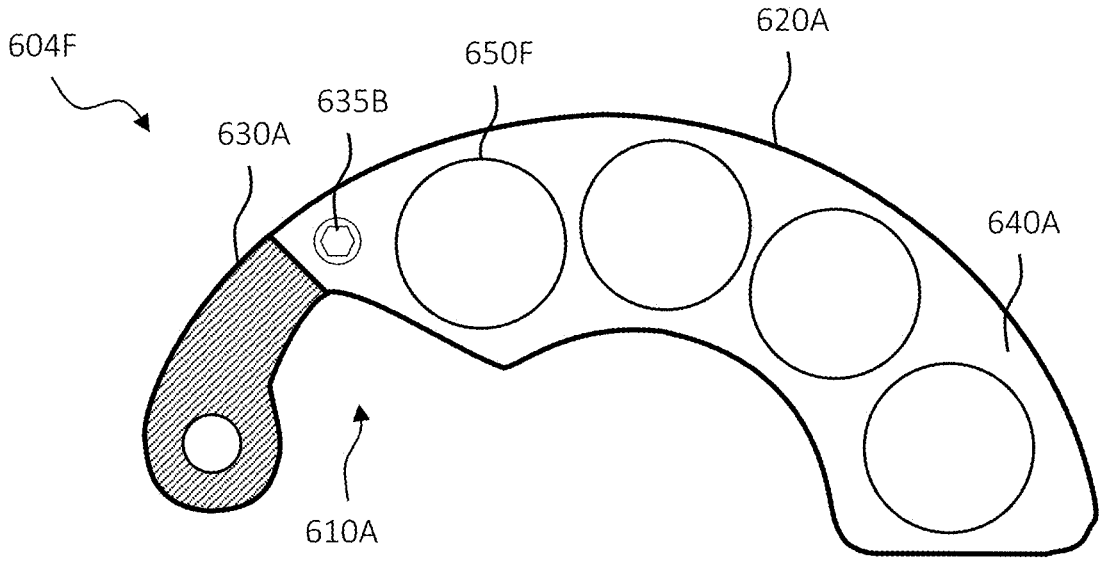

Turning now to FIG. 6F, illustrated is an alternative embodiment of a float 604F designed, manufactured, and operated according to another embodiment of the disclosure. The float 604F is similar in many respects to the float 604B of FIG. 6B. Accordingly, like reference numbers have been used to indicate similar, if not identical, features. The float 604F differs, for the most part, from the float 604B in that the float 604F employs water as the light-weight fluid, the water further including a handful of similarly sized spheres 650F (e.g., glass spheres) suspended therein, such that the net density for the float 604F is between the first density of the desired fluid and the second density of the undesired fluid.

Figure 6G:
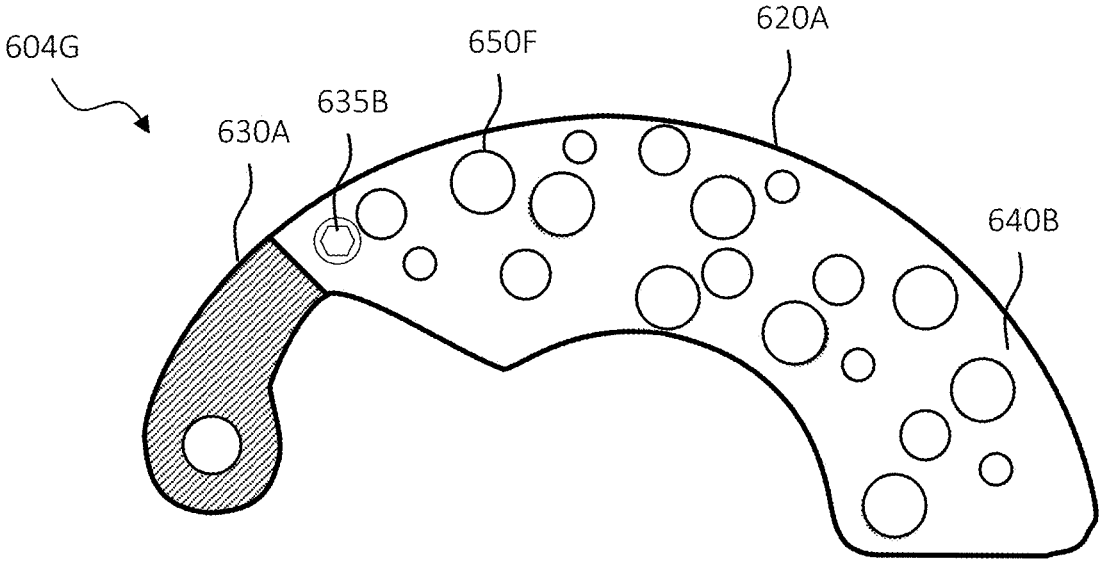

Turning now to FIG. 6G, illustrated is an alternative embodiment of a float 604G designed, manufactured, and operated according to another embodiment of the disclosure. The float 604G is similar in many respects to the float 604F of FIG. 6F. Accordingly, like reference numbers have been used to indicate similar, if not identical, features. The float 604G differs, for the most part, from the float 604F in that the float 604G employs water as the light-weight fluid, the water further including many different sized microglass spheres 650F suspended therein, such that the net density for the float 604G is between the first density of the desired fluid and the second density of the undesired fluid.

Figure 7A:
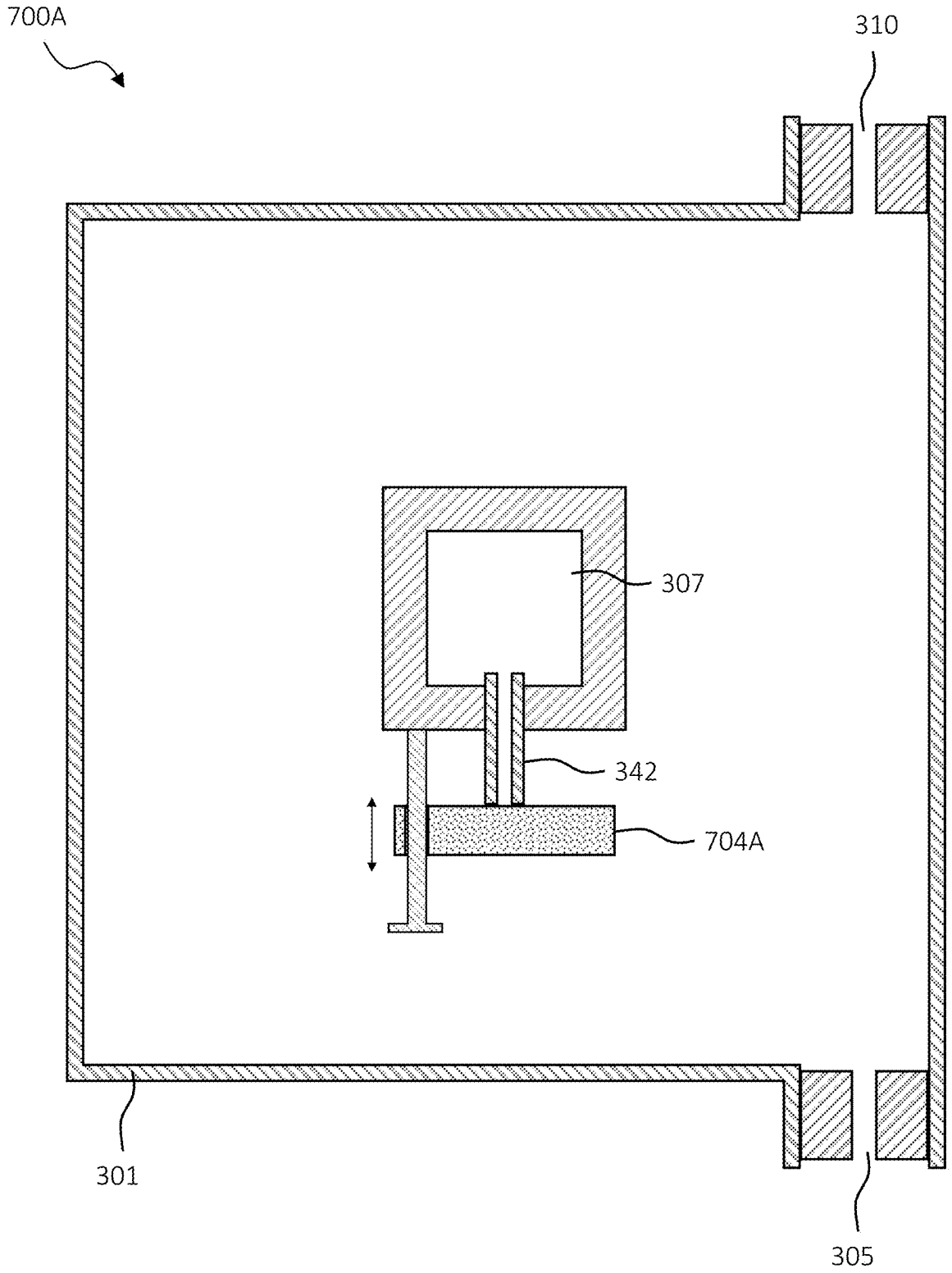
FIGS. 7A and 7B illustrates cross-sectional views of an alternative embodiment of a fluid flow control device designed, manufactured, and operated according to one or more embodiments of the disclosure.

Turning to FIG. 7A, illustrated is a cross-sectional view of an alternative embodiment of a fluid flow control device 700A designed, manufactured, and operated according to one or more embodiments of the disclosure. The fluid flow control device 700A is similar in many respects to the fluid flow control device 300 of FIG. 3. Accordingly, like reference numbers have been used to indicate similar, if not identical, features. The fluid flow control device 700A differs, for the most part, from the fluid flow control device 300, in that the fluid flow control device 700A does not employ the rotatable component 308. Alternatively, the fluid flow control device 700A employs a single paddle shaped float 704A. The single paddle shaped float 704A, in at least the illustrated embodiment, is operable to slide (e.g., linearly slide in one embodiment) between the open and closed positions, for example based upon the density of the fluid within the housing 301. In the embodiment of FIG. 7A, the single paddle shaped float 704A is configured to float upward to the closed position and sink downward to the open position, for example based upon the density of the fluid within the housing 301.

Figure 7B:
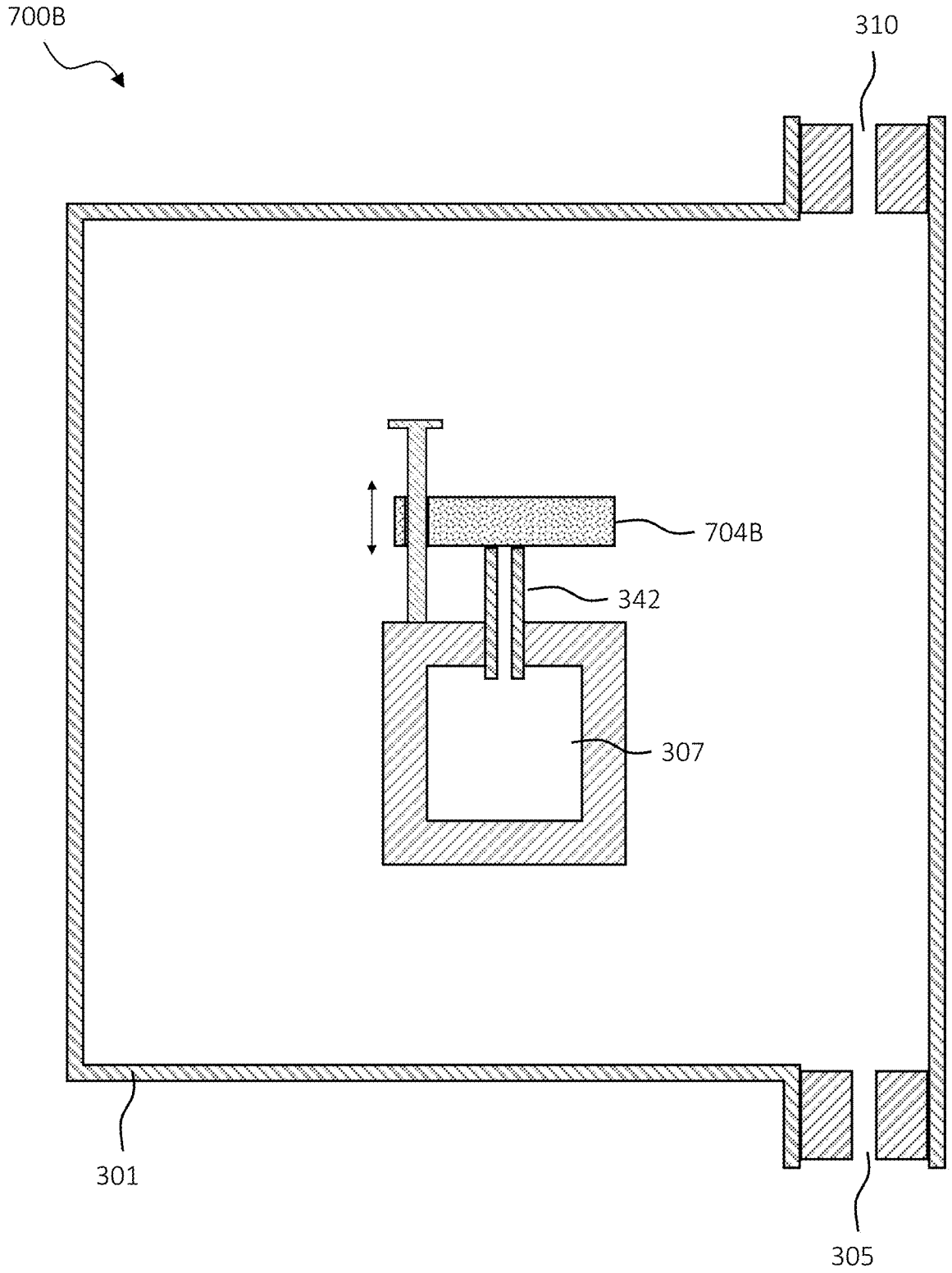

Turning to FIG. 7B, illustrated is a cross-sectional view of an alternative embodiment of a fluid flow control device 704B designed, manufactured, and operated according to one or more embodiments of the disclosure. The fluid flow control device 704B is similar in many respects to the fluid flow control device 704A of FIG. 7A. Accordingly, like reference numbers have been used to indicate similar, if not identical, features. The fluid flow control device 704B differs, for the most part, from fluid flow control device 704A, in that the single paddle shaped float 704B is configured to float upward to the open position and sink downward to the closed position, for example based upon the density of the fluid within the housing 301.

FIGS. 8A through 8G illustrate cross-sectional views of a variety of different floats (e.g., paddled shaped floats) 804A-804G designed, manufactured, and operated according to one or more embodiments of the disclosure, as might be used with the fluid flow control device 700A, 700B of FIGS. 7A and 7B. For example, each of the floats 804A-804G could be configured to slide (e.g., linearly slide) back and forth between the open and closed positions.

Each of the different floats 804A-804G illustrated in the embodiments of FIGS. 8A through 8G, in one form or another, includes a fluid tight enclosure (e.g., including an enclosed space, with or without a support structure) and density specific material located within the fluid tight enclosure. Accordingly, the fluid tight enclosure and the density specific material create a net density for the floats 804A-804G that is between a first density of a desired fluid and a second density of an undesired fluid, such that the floats 804A-804G may control fluid flow through a flow control device when encountering the desired fluid or the undesired fluid. In at least one embodiment, the floats 804A-804G have a net density that is above a first density of a desired fluid and below a second density of an undesired fluid. In another embodiment, the floats 804A-804G have a net density that is above a first density of an undesired fluid and below a second density of a desired fluid.

Figure 8A:
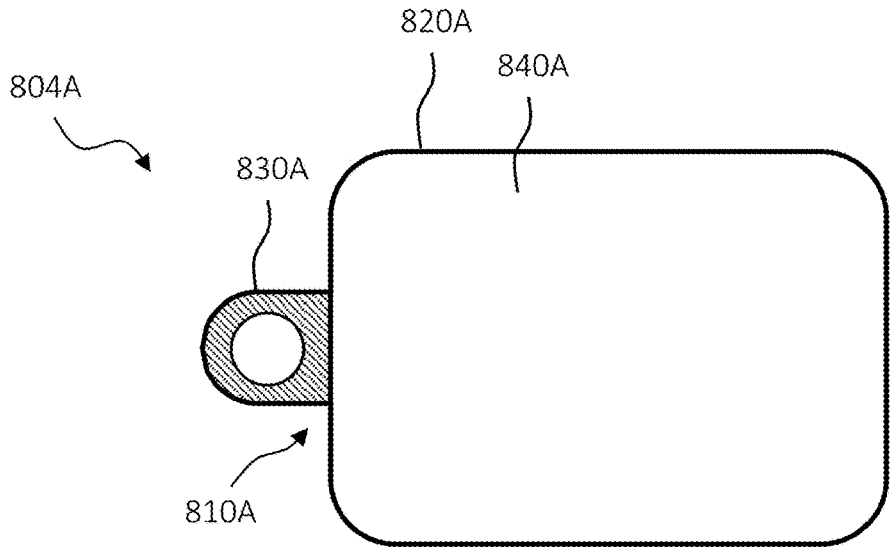
FIGS. 8A through 8G illustrate cross-sectional views of a variety of different floats (e.g., paddled shaped floats) designed, manufactured, and operated according to one or more embodiments of the disclosure, as might be used with the fluid flow control device of FIGS. 7A and 7B.

With initial reference to FIG. 8A, illustrated is one embodiment of a float 804A designed, manufactured, and operated according to one or more embodiments of the disclosure. The float 804A includes a fluid tight enclosure 810A. The fluid tight enclosure 810A in the embodiment of FIG. 8A includes an enclosed space 820A and a support structure 830A. The float 804A of FIG. 8A additionally includes a density specific material 840A located within the fluid tight enclosure 810A. In this embodiment, the fluid tight enclosure 810A and the density specific material 840A create a net density for the float 804A that is between a first density of a desired fluid and a second density of an undesired fluid. In the illustrated embodiment, the density specific material 840A is a light-weight solid, such that the net density for the float 804A is between the first density of the desired fluid and the second density of the undesired fluid. Those skilled in the art, particularly given that it is protected by the fluid tight enclosure 810A, understand the various different light-weight solids that may be used and remain within the scope of the disclosure.

Figure 8B:
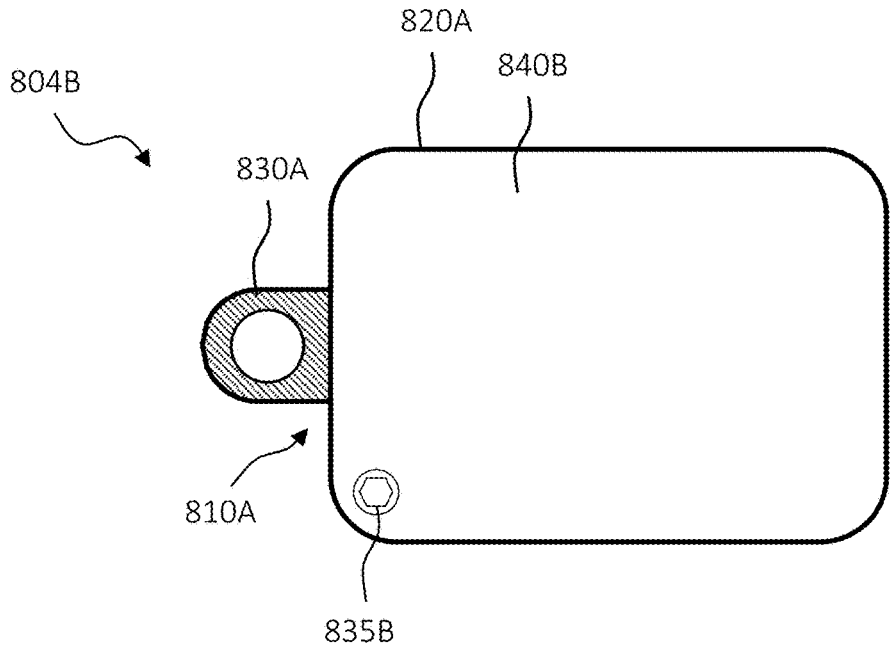

Turning now to FIG. 8B, illustrated is an alternative embodiment of a float 804B designed, manufactured, and operated according to another embodiment of the disclosure. The float 804B is similar in many respects to the float 804A of FIG. 8A. Accordingly, like reference numbers have been used to indicate similar, if not identical, features. The float 804B differs, for the most part, from the float 804A in that the float 804B employs a light-weight fluid as its density specific material 840B, such that the net density for the float 804B is between the first density of the desired fluid and the second density of the undesired fluid. In at least one embodiment, the light-weight fluid contains oil, for example among other fluids. In at least one other embodiment, the light-weight fluid is oil. In at least one other embodiment, the light-weight fluid includes gasses, for example among other fluids. Further to the embodiment of FIG. 8B, the float 804B may additionally include one or more fill ports (e.g., covered in the illustrated embodiment) and one or more fill plugs 835B.

Figure 8C:
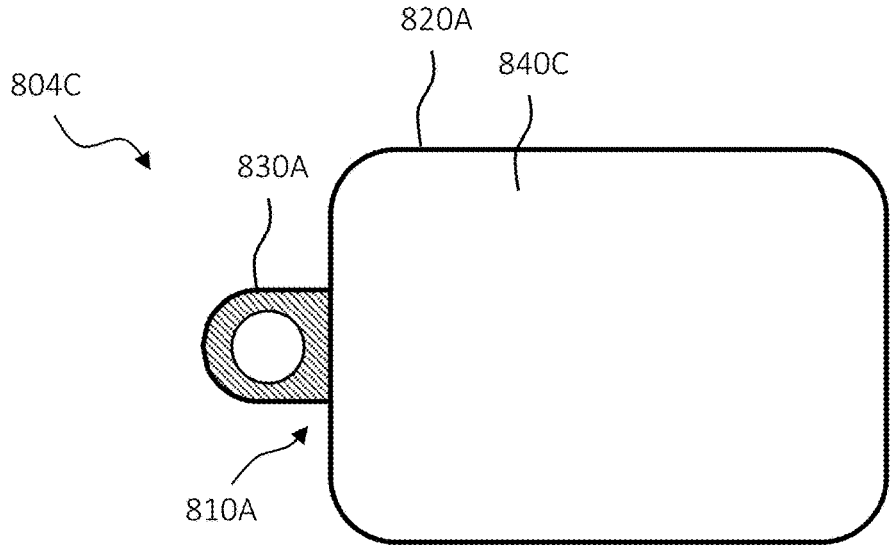

Turning now to FIG. 8C, illustrated is an alternative embodiment of a float 804C designed, manufactured, and operated according to another embodiment of the disclosure. The float 804C is similar in many respects to the float 804A of FIG. 8A. Accordingly, like reference numbers have been used to indicate similar, if not identical, features. The float 804C differs, for the most part, from the float 804A in that the float 804C employs a light-weight foam as its density specific material 840C. In the illustrated embodiment, the density specific material 840C is syntactic foam, for example including light weight material that is created by using hollow spheres, often made of glass, which are bound together with a base material (e.g., a thermoset polymer). Those skilled in the art understand that the syntactic foam, and the sizing of the hollow spheres, may be used to adjust the net density of the float 804C.

Figure 8D:
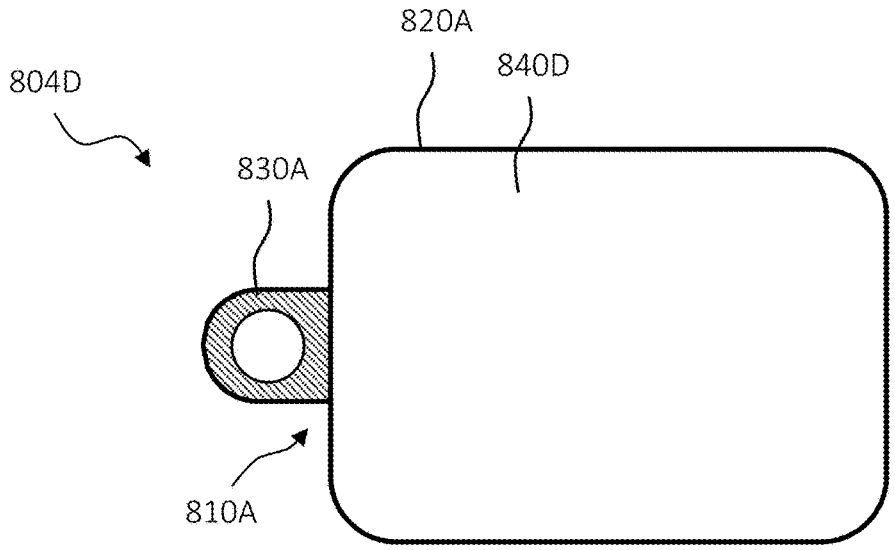

Turning now to FIG. 8D, illustrated is an alternative embodiment of a float 804D designed, manufactured, and operated according to another embodiment of the disclosure. The float 804D is similar in many respects to the float 804C of FIG. 8C. Accordingly, like reference numbers have been used to indicate similar, if not identical, features. The float 804D differs, for the most part, from the float 804C in that the float 804D employs an open cell foam as its density specific material 840D. Those skilled in the art understand that the open cell foam, and the sizing of the cells, may be used to adjust the net density of the float 804D.

Figure 8E:
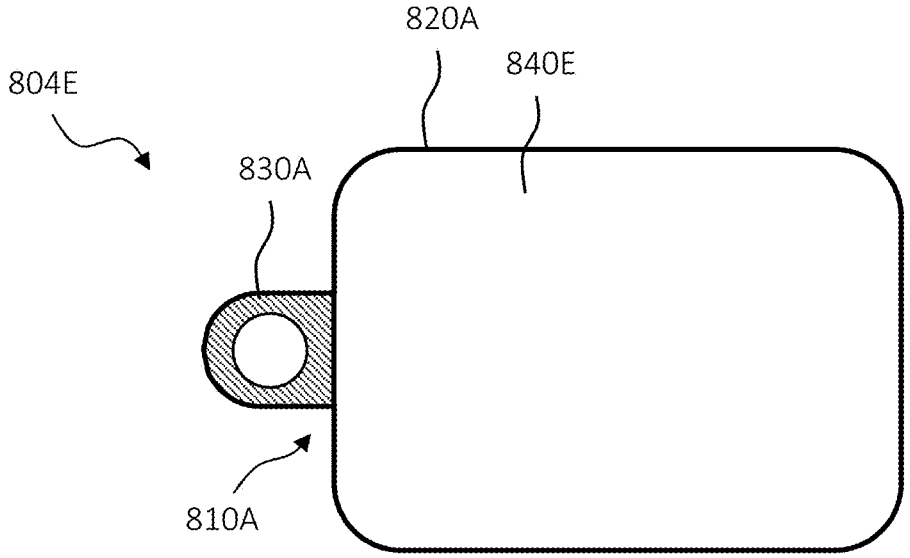

Turning now to FIG. 8E, illustrated is an alternative embodiment of a float 804E designed, manufactured, and operated according to another embodiment of the disclosure. The float 804E is similar in many respects to the float 804C of FIG. 8C. Accordingly, like reference numbers have been used to indicate similar, if not identical, features. The float 804E differs, for the most part, from the float 804C in that the float 804E employs closed cell foam as its density specific material 840E. Those skilled in the art understand that the closed cell foam, and the sizing of the cells, may be used to adjust the net density of the float 804E.

Figure 8F:
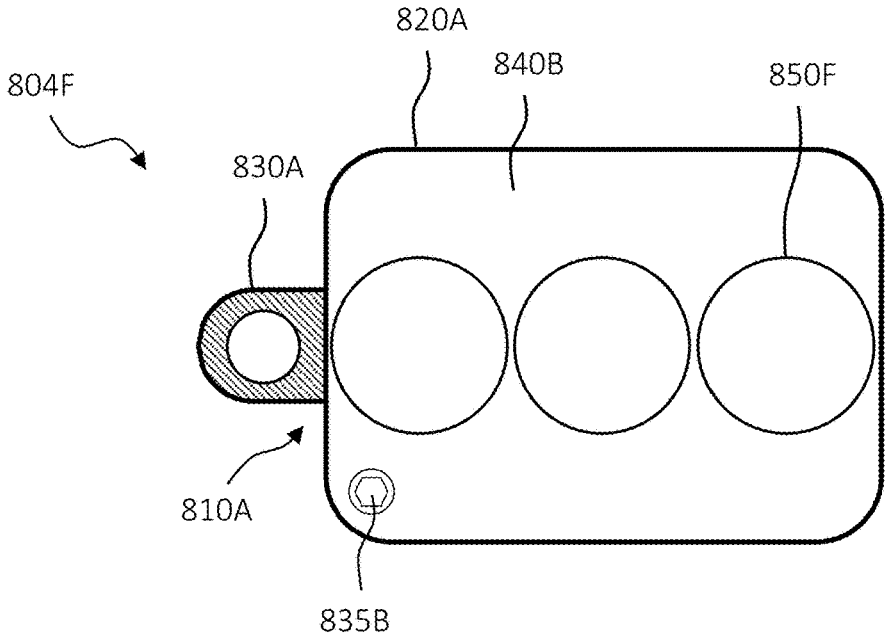

Turning now to FIG. 8F, illustrated is an alternative embodiment of a float 804F designed, manufactured, and operated according to another embodiment of the disclosure. The float 804F is similar in many respects to the float 804B of FIG. 8B. Accordingly, like reference numbers have been used to indicate similar, if not identical, features. The float 804F differs, for the most part, from the float 804B in that the float 804F employs water as the light-weight fluid, the water further including a handful of similarly sized micro-glass spheres 850F suspended therein, such that the net density for the float 804F is between the first density of the desired fluid and the second density of the undesired fluid.

Figure 8G:
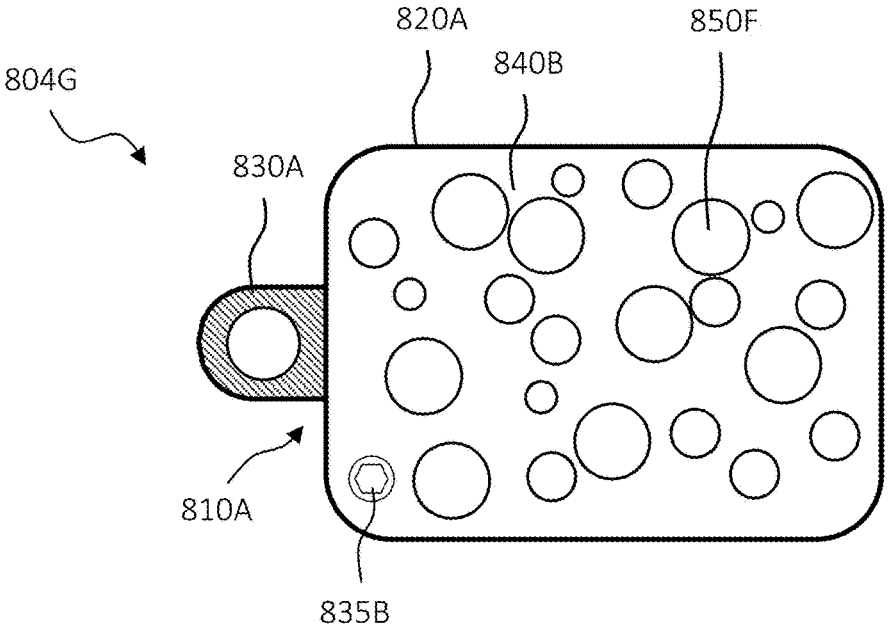

Turning now to FIG. 8G, illustrated is an alternative embodiment of a float 804G designed, manufactured, and operated according to another embodiment of the disclosure. The float 804G is similar in many respects to the float 804F of FIG. 8F. Accordingly, like reference numbers have been used to indicate similar, if not identical, features. The float 804G differs, for the most part, from the float 804F in that the float 804G employs water as the light-weight fluid, the water further including many different sized microglass spheres 850F suspended therein, such that the net density for the float 804G is between the first density of the desired fluid and the second density of the undesired fluid.

Turning to FIG. 9A, illustrated is a cross-sectional view of an alternative embodiment of a fluid flow control device 900A designed, manufactured, and operated according to one or more embodiments of the disclosure. The fluid flow control device 900A is similar in many respects to the fluid flow control device 300 of FIG. 3. Accordingly, like reference numbers have been used to indicate similar, if not identical, features. The fluid flow control device 900A differs, for the most part, from the fluid flow control device 300, in that the fluid flow control device 900A does not employ the rotatable component 308. Alternatively, the fluid flow control device 900A employs a single spherical shaped float 904A. The single spherical shaped float 904A, in at least the illustrated embodiment, is operable to float upward to close the fluid outlet 307 when its density is less than the fluid density of a desirable fluid, or sink downward to open the fluid outlet 307 when its density is greater than the fluid density of the desirable fluid. It should be apparent that the fluid flow control device 900A could be reversed so that the sphere 904A restricts the fluid outlet 307 when its density is greater than the fluid density of a desired fluid, such as shown in FIG. 9B employing the sphere 904B.

Figure 10:
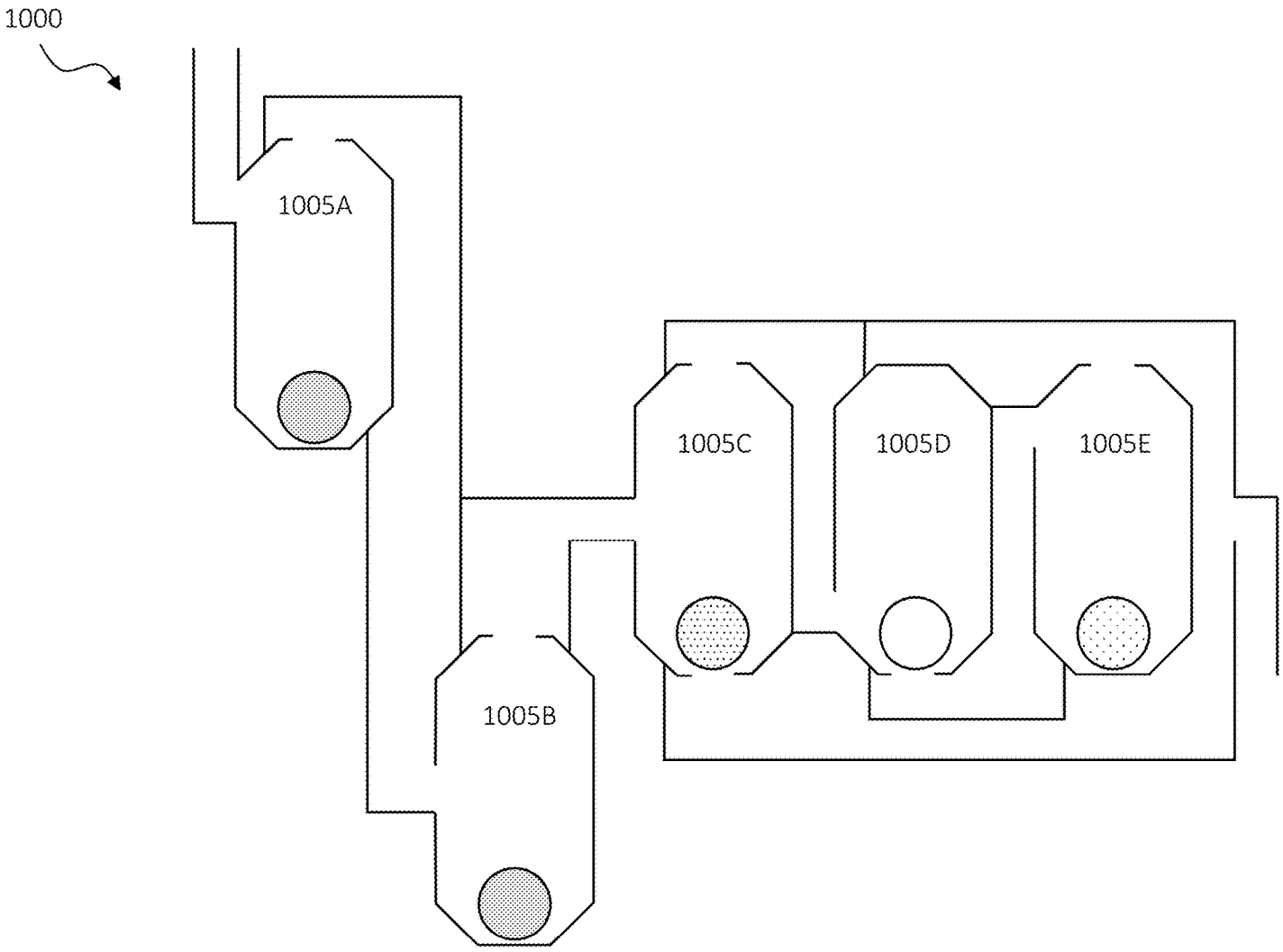
FIG. 10 illustrates an orientation dependent inflow control apparatus designed, manufactured, and operated according to one or more embodiments of the disclosure.

FIG. 10 illustrates an orientation dependent inflow control apparatus 1000 designed, manufactured and operated according to one or more embodiments of the disclosure. In the embodiment of FIG. 10, multiple fluid flow control devices 1005A-1005E are stacked to assist with certain orientation issues that may exist when the fluid flow control device 900A, 900B is positioned on a tubular downhole. The multiple fluid flow control devices 1005A-1005E may also be used to discriminate fluid flow based upon more than just two different densities.

FIG. 11 illustrates a rolled-out view (360°) of a device 1100 comprising four orientation dependent inflow control apparatuses 1000A-1000D equidistantly distributed around the perimeter outside of a basepipe (not shown). In FIG. 11 the reference indications x and x' are connected to one another, as well as the reference indications y and y' are connected to one another. Each of the four orientation dependent inflow control apparatuses 1000A-1000D is in fluid communication with a corresponding density control valve to form a density control valve system. The orientation of each of the four orientation dependent inflow control apparatuses 1000A-1000D is indicated by the g-vectors (g) where the indication + is to be understood to be in a direction into the drawing, the downward arrow is in a direction vertically down, the ● is in a direction out of the drawing and the upward arrow is in a direction vertically up.

FIGS. 12A through 12G illustrate cross-sectional views of a variety of different floats (e.g., sphere shaped floats) 1204A-1204G designed, manufactured, and operated according to one or more embodiments of the disclosure, as might be used with the fluid flow control device 900A, 900B of FIGS. 9A and 9B. For example, each of the floats 1204A-1204G could be configured to float and/or sink back and forth between the open and closed positions.

Each of the different floats 1204A-1204G illustrated in the embodiments of FIGS. 12A through 12G, in one form or another, includes a fluid tight enclosure (e.g., including an enclosed space, and in this embodiment without a support structure) and density specific material located within the fluid tight enclosure. In one or more embodiments, the different floats 1204A-1204G include only a single sheet of material physically attached together to form the enclosed space. Accordingly, the fluid tight enclosure and the density specific material create a net density for the floats 1204A-1204G that is between a first density of a desired fluid and a second density of an undesired fluid, such that the floats 1204A-1204G may control fluid flow through a flow control device when encountering the desired fluid or the undesired fluid. In at least one embodiment, the floats 1204A-1204G have a net density that is above a first density of a desired fluid and below a second density of an undesired fluid. In another embodiment, the floats 1204A-1204G have a net density that is above a first density of an undesired fluid and below a second density of a desired fluid.

Figure 12A:
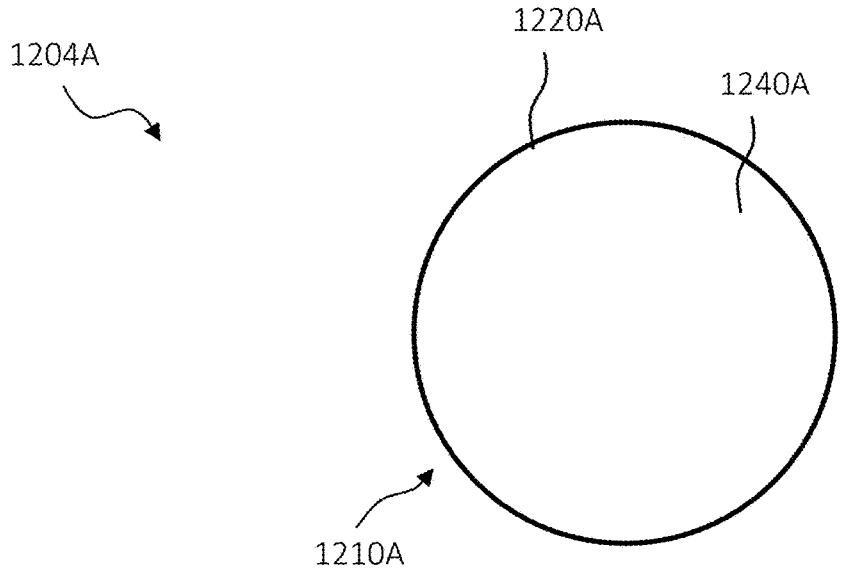

With initial reference to FIG. 12A, illustrated is one embodiment of a float 1204A designed, manufactured, and operated according to one or more embodiments of the disclosure. The float 1204A includes a fluid tight enclosure 1210A. The fluid tight enclosure 1210A in the embodiment of FIG. 12A includes an enclosed space 1220A, but does not include a support structure. The float 1204A of FIG. 12A additionally includes a density specific material 1240A located within the fluid tight enclosure 1210A. In this embodiment, the fluid tight enclosure 1210A and the density specific material 1240A create a net density for the float 1204A that is between a first density of a desired fluid and a second density of an undesired fluid. In the illustrated embodiment, the density specific material 1240A is a light-weight solid, such that the net density for the float 1204A is between the first density of the desired fluid and the second density of the undesired fluid. Those skilled in the art, particularly given that it is protected by the fluid tight enclosure 1210A, understand the various different light-weight solids that may be used and remain within the scope of the disclosure.

Figure 12B:
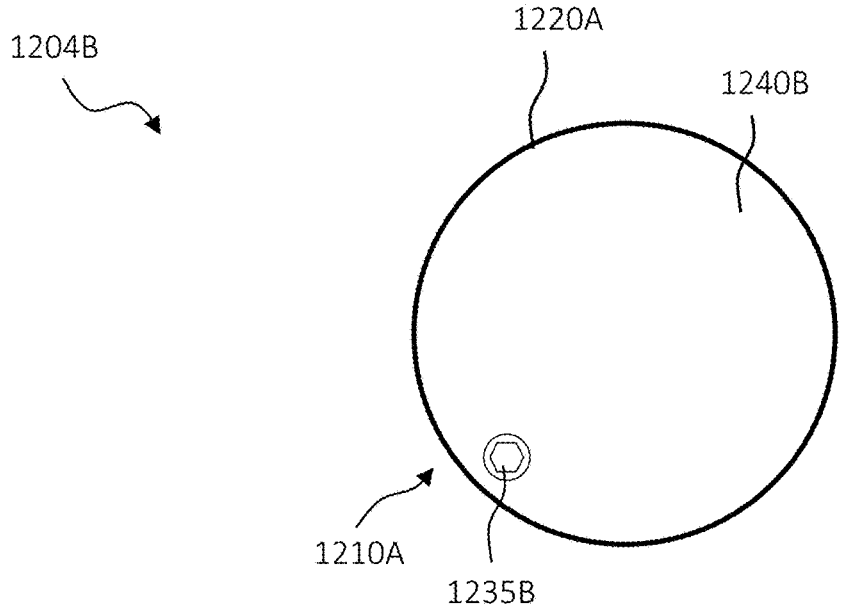

Turning now to FIG. 12B, illustrated is an alternative embodiment of a float 1204B designed, manufactured, and operated according to another embodiment of the disclosure. The float 1204B is similar in many respects to the float 1204A of FIG. 12A. Accordingly, like reference numbers have been used to indicate similar, if not identical, features. The float 1204B differs, for the most part, from the float 1204A in that the float 1204B employs a light-weight fluid as its density specific material 1240B, such that the net density for the float 1204B is between the first density of the desired fluid and the second density of the undesired fluid. In at least one embodiment, the light-weight fluid contains oil, for example among other fluids. In at least one other embodiment, the light-weight fluid is oil. In at least one other embodiment, the light-weight fluid includes gasses, for example among other fluids. Further to the embodiment of FIG. 12B, the float 1204B may additionally include one or more fill ports (e.g., covered in the illustrated embodiment) and one or more fill plugs 1235B.

Figure 12C:
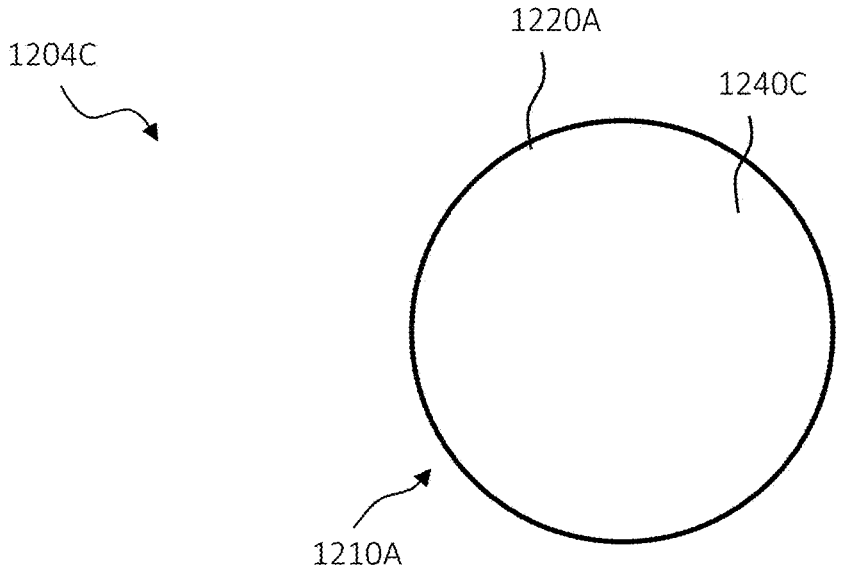

Turning now to FIG. 12C, illustrated is an alternative embodiment of a float 1204C designed, manufactured, and operated according to another embodiment of the disclosure. The float 1204C is similar in many respects to the float 1204A of FIG. 12A. Accordingly, like reference numbers have been used to indicate similar, if not identical, features. The float 1204C differs, for the most part, from the float 1204A in that the float 1204C employs a light-weight foam as its density specific material 1240C. In the illustrated embodiment, the density specific material 1240C is syntactic foam, for example including light weight material that is created by using hollow spheres, often made of glass, which are bound together with a base material (e.g., a thermoset polymer). Those skilled in the art understand that the syntactic foam, and the sizing of the hollow spheres, may be used to adjust the net density of the float 1204C.

Figure 12D:
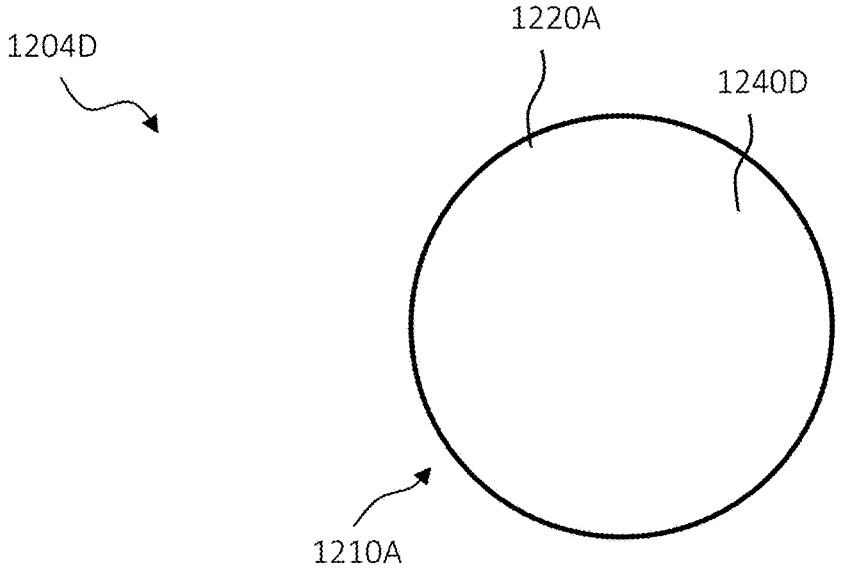

Turning now to FIG. 12D, illustrated is an alternative embodiment of a float 1204D designed, manufactured, and operated according to another embodiment of the disclosure. The float 1204D is similar in many respects to the float 1204C of FIG. 12C. Accordingly, like reference numbers have been used to indicate similar, if not identical, features. The float 1204D differs, for the most part, from the float 1204C in that the float 1204D employs an open cell foam as its density specific material 1240D. Those skilled in the art understand that the open cell foam, and the sizing of the cells, may be used to adjust the net density of the float 1204D.

Figure 12E:
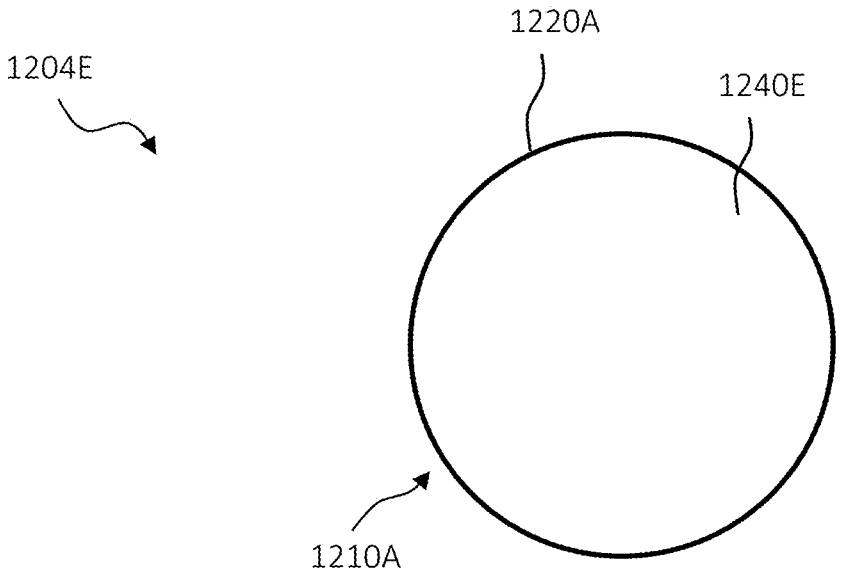

Turning now to FIG. 12E, illustrated is an alternative embodiment of a float 1204E designed, manufactured, and operated according to another embodiment of the disclosure. The float 1204E is similar in many respects to the float 1204C of FIG. 12C. Accordingly, like reference numbers have been used to indicate similar, if not identical, features. The float 1204E differs, for the most part, from the float 1204C in that the float 1204E employs closed cell foam as its density specific material 1240E. Those skilled in the art understand that the closed cell foam, and the sizing of the cells, may be used to adjust the net density of the float 1204E.

Figure 12F:
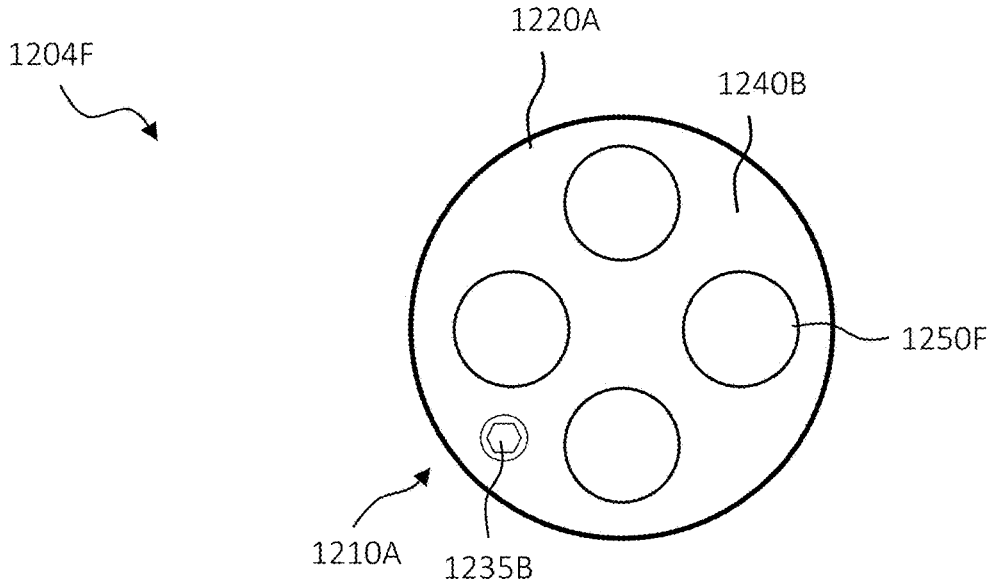

Turning now to FIG. 12F, illustrated is an alternative embodiment of a float 1204F designed, manufactured, and operated according to another embodiment of the disclosure. The float 1204F is similar in many respects to the float 1204B of FIG. 12B. Accordingly, like reference numbers have been used to indicate similar, if not identical, features. The float 1204F differs, for the most part, from the float 1204B in that the float 1204F employs water as the light-weight fluid, the water further including a handful of similarly sized microglass spheres 1250F suspended therein, such that the net density for the float 1204F is between the first density of the desired fluid and the second density of the undesired fluid.

Figure 12G:
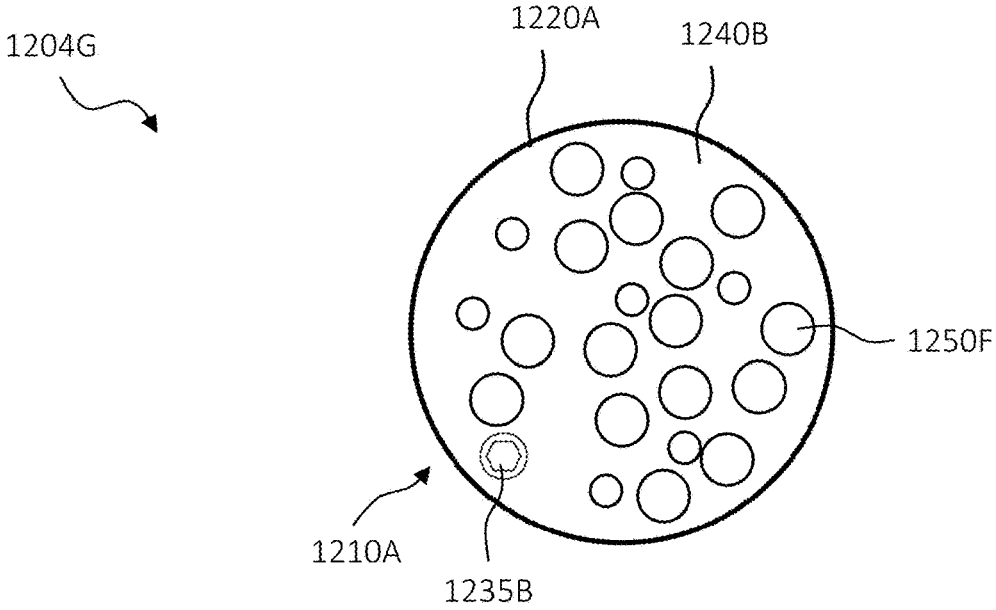

Turning now to FIG. 12G, illustrated is an alternative embodiment of a float 1204G designed, manufactured, and operated according to another embodiment of the disclosure. The float 1204G is similar in many respects to the float 1204F of FIG. 12F. Accordingly, like reference numbers have been used to indicate similar, if not identical, features. The float 1204G differs, for the most part, from the float 1204F in that the float 1204G employs water as the light-weight fluid, the water further including many different sized microglass spheres 1250F suspended therein, such that the net density for the float 1204G is between the first density of the desired fluid and the second density of the undesired fluid.

Aspects disclosed herein include:

A. A float for use with a fluid flow control device, the float including: 1) a fluid tight enclosure; and 2) density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

B. A fluid flow control device, the fluid flow control device including: 1) an inlet port; 2) an outlet port; and 3) a float positioned between the inlet port and the outlet port, the float movable between an open position that allows fluid flow through the outlet port and a closed position that restricts fluid flow through the outlet port, the float including: a) a fluid tight enclosure; and b) density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

C. A method for manufacturing a fluid flow control device, the method including: 1) providing an enclosed space; 2) placing density specific material within the enclosed space; and 3) sealing the enclosed space to form a fluid tight enclosure, wherein the fluid tight enclosure and the density specific material create a net density for the float that is between a first density of a desired fluid and a second density of an undesired fluid, such that the float may control fluid flow through a flow control device when encountering the desired fluid or the undesired fluid.

D. A well system, the well system including: 1) a wellbore formed through a subterranean formation; 2) a tubing string positioned within the wellbore; and 3) a fluid flow control device coupled to the tubing string, the fluid flow control device including: a) an inlet port; b) an outlet port; and c) a float positioned between the inlet port and the outlet port, the float movable between an open position that allows fluid flow through the outlet port and a closed position that restricts fluid flow through the outlet port, the float including: i) a fluid tight enclosure; and ii) density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

Aspects A, B, C, and D may have one or more of the following additional elements in combination: Element 1: wherein the fluid tight enclosure includes an enclosed space having a wall thickness (t) of less than 2.54 mm. Element 2: wherein the fluid tight enclosure includes an enclosed space having a wall thickness (t) of less than 1.27 mm. Element 3: wherein the fluid tight enclosure includes an enclosed space having a wall thickness (t) of less than 0.254 mm. Element 4: wherein the fluid tight enclosure includes an enclosed space formed of one or more sheets of material physically attached together. Element 5: wherein the one or more sheets of material physically attached together are two or more sheets of metal physically attached together. Element 6: wherein the two or more sheets of metal physically attached together are two or more sheets of metal welded together. Element 7: further including a support structure coupled to an exposed end of the enclosed space. Element 8: wherein the support structure is welded to the exposed end of the enclosed space to form the fluid tight enclosure. Element 9: wherein the support structure is a hinge structure. Element 10: wherein the hinge structure is a counterweight hinge structure configured to fine tune the net density of the float. Element 11: further including one or more fill ports in the support structure or the enclosed space to place the density specific material within the fluid tight enclosure. Element 12: wherein the density specific material is a light-weight fluid such that the net density for the float is between the first density of the desired fluid and the second density of the undesired fluid. Element 13: wherein the light-weight fluid is oil. Element 14: wherein the light-weight fluid is water, the water further including microglass spheres suspended therein such that the net density for the float is between the first density of the desired fluid and the second density of the undesired fluid. Element 15: wherein the density specific material is a light-weight solid such that the net density for the float is between the first density of the desired fluid and the second density of the undesired fluid. Element 16: wherein the light-weight solid is foam. Element 17: wherein the foam is syntactic foam. Element 18: wherein the foam is closed cell foam or open cell foam. Element 19: wherein the fluid tight enclosure having the density specific material located therein is fluid tight to at least 68.9 Bar. Element 20: wherein sealing the enclosed space includes coupling a support structure to an exposed end of the enclosed space. Element 21: wherein coupling the support structure to the exposed end of the enclosed space includes welding the support structure to the exposed end of the enclosed space. Element 22: wherein coupling the support structure to the exposed end of the enclosed space occurs prior to the placing the density specific material within the enclosed space. Element 23: wherein placing the density specific material within the enclosed space includes placing the density specific material within the enclosed space via one or more fill ports located in the support structure or the enclosed space.

Those skilled in the art to which this application relates will appreciate that other and further additions, deletions, substitutions, and modifications may be made to the described embodiments.

What is claimed is:

1. A float for use with a fluid flow control device, comprising:

a fluid tight enclosure, the fluid tight enclosure having an enclosed space having a wall thickness (t) of less than 2.54 mm; and density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

2. The float as recited in claim 1, wherein the fluid tight enclosure includes the enclosed space having the wall thickness (t) of less than 1.27 mm.

3. The float as recited in claim 1, wherein the fluid tight enclosure includes the enclosed space having the wall thickness (t) of less than 0.254 mm.

4. The float as recited in claim 1, wherein the fluid tight enclosure includes the enclosed space formed of one or more sheets of material physically attached together.

5. The float as recited in claim 4, wherein the one or more sheets of material physically attached together are two or more sheets of metal physically attached together.

6. The float as recited in claim 5, wherein the two or more sheets of metal physically attached together are two or more sheets of metal welded together.

7. The float as recited in claim 4, further including a support structure coupled to an exposed end of the enclosed space.

8. The float as recited in claim 7, wherein the support structure is welded to the exposed end of the enclosed space to form the fluid tight enclosure.

9. The float as recited in claim 8, wherein the support structure is a hinge structure.

10. The float as recited in claim 9, wherein the hinge structure is a counterweight hinge structure configured to fine tune the net density of the float.

11. The float as recited in claim 7, further including one or more fill ports in the support structure or the enclosed space to place the density specific material within the fluid tight enclosure.

12. The float as recited in claim 1, wherein the density specific material is a light-weight fluid such that the net density for the float is between the first density of the desired fluid and the second density of the undesired fluid.

13. The float as recited in claim 12, wherein the light-weight fluid is oil.

14. The float as recited in claim 12, wherein the light-weight fluid is water, the water further including microglass spheres suspended therein such that the net density for the float is between the first density of the desired fluid and the second density of the undesired fluid.

15. The float as recited in claim 1, wherein the density specific material is a light-weight solid such that the net density for the float is between the first density of the desired fluid and the second density of the undesired fluid.

16. The float as recited in claim 15, wherein the light-weight solid is foam.

17. The float as recited in claim 16, wherein the foam is syntactic foam.

18. The float as recited in claim 16, wherein the foam is closed cell foam or open cell foam.

19. The float as recited in claim 1, wherein the fluid tight enclosure having the density specific material located therein is fluid tight to at least 68.9 Bar.

20. A fluid flow control device, comprising:

an inlet port;

an outlet port; and a float positioned between the inlet port and the outlet port, the float movable between an open position that allows fluid flow through the outlet port and a closed position that restricts fluid flow through the outlet port, the float including:

a fluid tight enclosure, the fluid tight enclosure having an enclosed space having a wall thickness (t) of less than 2.54 mm; and density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

21. The fluid flow control device as recited in claim 20, wherein the fluid tight enclosure includes the enclosed space having the wall thickness (t) of less than 1.27 mm.

22. The fluid flow control device as recited in claim 20, wherein the fluid tight enclosure includes the enclosed space having the wall thickness (t) of less than 0.254 mm.

23. The fluid flow control device as recited in claim 20, wherein the fluid tight enclosure includes the enclosed space formed of one or more sheets of material physically attached together.

24. The fluid flow control device as recited in claim 23, wherein the one or more sheets of material physically attached together are two or more sheets of metal physically attached together.

25. The fluid flow control device as recited in claim 24, wherein the two or more sheets of metal physically attached together are two or more sheets of metal welded together.

26. The fluid flow control device as recited in claim 23, further including a support structure coupled to an exposed end of the enclosed space.

27. The fluid flow control device as recited in claim 26, wherein the support structure is welded to the exposed end of the enclosed space to form the fluid tight enclosure.

28. The fluid flow control device as recited in claim 27, wherein the support structure is a hinge structure.

29. The fluid flow control device as recited in claim 28, wherein the hinge structure is a counterweight hinge structure configured to fine tune the net density of the float.

30. The fluid flow control device as recited in claim 26, further including one or more fill ports in the support structure or the enclosed space to place the density specific material within the fluid tight enclosure.

31. The fluid flow control device as recited in claim 20, wherein the density specific material is a light-weight fluid such that the net density for the float is between the first density of the desired fluid and the second density of the undesired fluid.

32. The fluid flow control device as recited in claim 31, wherein the light-weight fluid is oil.

33. The fluid flow control device as recited in claim 31, wherein the light-weight fluid is water, the water further including microglass spheres suspended therein such that the net density for the float is between the first density of the desired fluid and the second density of the undesired fluid.

34. The fluid flow control device as recited in claim 20, wherein the density specific material is a light-weight solid such that the net density for the float is between the first density of the desired fluid and the second density of the undesired fluid.

35. The fluid flow control device as recited in claim 34, wherein the light-weight solid is foam.

36. The fluid flow control device as recited in claim 35, wherein the foam is syntactic foam.

37. The fluid flow control device as recited in claim 35, wherein the foam is closed cell foam or open cell foam.

38. The fluid flow control device as recited in claim 20, wherein the fluid tight enclosure having the density specific material located therein is fluid tight to at least 68.9 Bar.

39. A method for manufacturing a fluid flow control device, comprising:

providing an enclosed space, the enclosed space having a wall thickness (t) of less than 2.54 mm;

placing density specific material within the enclosed space; and sealing the enclosed space to form a fluid tight enclosure, wherein the fluid tight enclosure and the density specific material create a net density for the float that is between a first density of a desired fluid and a second density of an undesired fluid, such that the float may control fluid flow through a flow control device when encountering the desired fluid or the undesired fluid.

40. The method as recited in claim 39, wherein sealing the enclosed space includes coupling a support structure to an exposed end of the enclosed space.

41. The method as recited in claim 40, wherein coupling the support structure to the exposed end of the enclosed space includes welding the support structure to the exposed end of the enclosed space.

42. The method as recited in claim 40, wherein coupling the support structure to the exposed end of the enclosed space occurs prior to the placing the density specific material within the enclosed space.

43. The method as recited in claim 41, wherein placing the density specific material within the enclosed space includes placing the density specific material within the enclosed space via one or more fill ports located in the support structure or the enclosed space.

44. A well system, comprising:

a wellbore formed through a subterranean formation;

a tubing string positioned within the wellbore; and a fluid flow control device coupled to the tubing string, the fluid flow control device including:

an inlet port;

an outlet port; and a float positioned between the inlet port and the outlet port, the float movable between an open position that allows fluid flow through the outlet port and a closed position that restricts fluid flow through the outlet port, the float including:

a fluid tight enclosure, the fluid tight enclosure having an enclosed space having a wall thickness (t) of less than 2.54 mm; and density specific material located within the fluid tight enclosure, the fluid tight enclosure and the density specific material creating a net density for the float that is between a first density of a desired fluid and a second density of an undesired fluid, such that the float may control fluid flow through a flow control device when encountering the desired fluid or the undesired fluid.

* * * * *